US010599060B2

(12) United States Patent
Kanno et al.

(10) Patent No.: US 10,599,060 B2
(45) Date of Patent: Mar. 24, 2020

(54) TONER

(71) Applicant: CANON KABUSHIKI KAISHA, Tokyo (JP)

(72) Inventors: Ichiro Kanno, Kashiwa (JP); Takeshi Hashimoto, Moriya (JP); Nozomu Komatsu, Toride (JP); Masayuki Hama, Toride (JP); Yuto Onozaki, Saitama (JP); Megumi Ikeda, Kashiwa (JP); Hiroyuki Fujikawa, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/205,501

(22) Filed: Nov. 30, 2018

(65) Prior Publication Data

US 2019/0171125 A1 Jun. 6, 2019

(30) Foreign Application Priority Data

Dec. 6, 2017 (JP) ..... 2017-234174

(51) Int. Cl.

| | |
|---|---|
| ***G03G 9/08*** | (2006.01) |
| ***G03G 9/09*** | (2006.01) |
| ***G03G 9/087*** | (2006.01) |
| ***G03G 9/097*** | (2006.01) |

(52) U.S. Cl.

CPC ..... *G03G 9/0906* (2013.01); *G03G 9/08755* (2013.01); *G03G 9/08786* (2013.01); *G03G 9/091* (2013.01); *G03G 9/09733* (2013.01)

(58) Field of Classification Search

CPC ... G03G 9/0906; G03G 9/091; G03G 9/08755
USPC ..... 430/108.21
See application file for complete search history.

(56) References Cited

U.S. PATENT DOCUMENTS

| | | | |
|---|---|---|---|
| 5,580,980 | A | 12/1996 | Etzbach et al. |
| 5,968,701 | A | 10/1999 | Onuma et al. |
| 6,020,102 | A | 2/2000 | Fujimoto et al. |
| 6,120,961 | A | 9/2000 | Tanikawa et al. |
| 6,156,471 | A | 12/2000 | Kobori et al. |
| 6,203,959 | B1 | 3/2001 | Tanikawa et al. |
| 6,235,441 | B1 | 5/2001 | Tanikawa et al. |
| 6,430,384 | B2 | 8/2002 | Hama et al. |
| 6,653,036 | B1 | 11/2003 | Tanikawa et al. |
| 6,670,087 | B2 | 12/2003 | Fujikawa et al. |
| 6,751,424 | B2 | 6/2004 | Komatsu et al. |
| 6,808,852 | B2 | 10/2004 | Hotta et al. |
| 7,112,395 | B2 | 9/2006 | Ida et al. |
| 7,135,263 | B2 | 11/2006 | Kawakami et al. |
| 7,147,980 | B2 | 12/2006 | Itakura et al. |
| 7,147,981 | B2 | 12/2006 | Fujikawa et al. |
| 7,229,727 | B2 | 6/2007 | Itakura et al. |
| 7,279,262 | B2 | 10/2007 | Fujikawa et al. |
| 7,288,348 | B2 | 10/2007 | Hayami et al. |
| 7,297,455 | B2 | 11/2007 | Fujikawa et al. |
| 7,300,733 | B2 | 11/2007 | Sugahara et al. |
| 7,320,850 | B2 | 1/2008 | Itakura et al. |
| 7,396,626 | B2 | 7/2008 | Fujikawa et al. |
| 7,396,629 | B2 | 7/2008 | Baba et al. |
| 7,452,647 | B2 | 11/2008 | Hayami et al. |
| 7,611,813 | B2 | 11/2009 | Ida et al. |
| 7,858,283 | B2 | 12/2010 | Ishigami et al. |

(Continued)

FOREIGN PATENT DOCUMENTS

| | | |
|---|---|---|
| JP | 2005-107147 | 4/2005 |
| JP | 2006-133348 | 5/2006 |

(Continued)

*Primary Examiner* — Mark A Chapman
(74) *Attorney, Agent, or Firm* — Venable LLP

(57) ABSTRACT

A toner including: a toner particle, wherein the toner particle contains a binder resin, a compound represented by formula (1) below, and a compound in which at least a compound represented by formula (2) below and a compound represented by formula (3) below are in solid solution.

In formula (1), $R_1$, $R_2$, $R_3$, and $R_6$ each independently represent an alkyl group or aryl group, and $R_4$ and $R_5$ each independently represent an aryl group, acyl group, or alkyl group, or $R_4$ is bonded to $R_5$ to form a cyclic organic functional group that contains $R_4$, $R_5$, and the nitrogen atom to which $R_4$ and $R_5$ are bonded.

(1)

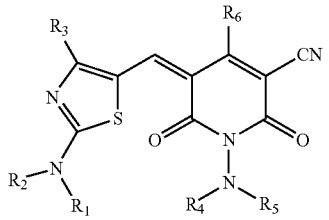

(2)

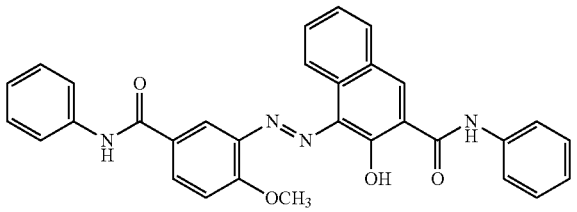

(3)

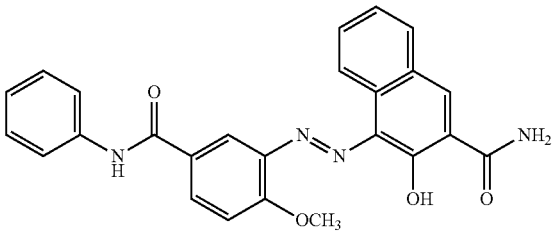

6 Claims, No Drawings

(56) References Cited

U.S. PATENT DOCUMENTS

| | | | |
|---|---|---|---|
| 7,927,775 | B2 | 4/2011 | Komatsu et al. |
| 7,939,233 | B2 | 5/2011 | Inoue et al. |
| 8,137,886 | B2 | 3/2012 | Baba et al. |
| 8,142,972 | B2 | 3/2012 | Hotta et al. |
| 8,921,023 | B2 | 12/2014 | Baba et al. |
| 8,927,188 | B2 | 1/2015 | Naka et al. |
| 8,986,914 | B2 | 3/2015 | Fujikawa et al. |
| 9,034,549 | B2 | 5/2015 | Shiotari et al. |
| 9,058,924 | B2 | 6/2015 | Komatsu et al. |
| 9,063,443 | B2 | 6/2015 | Ishigami et al. |
| 9,146,486 | B2 | 9/2015 | Shintou et al. |
| 9,152,088 | B1 | 10/2015 | Kobori et al. |
| 9,256,148 | B2 | 2/2016 | Fujikawa et al. |
| 9,348,253 | B2 | 5/2016 | Kanno et al. |
| 9,417,540 | B2 | 8/2016 | Hashimoto et al. |
| 9,436,112 | B2 | 9/2016 | Iwasaki et al. |
| 9,500,975 | B2 | 11/2016 | Sugahara et al. |
| 9,599,920 | B2 | 3/2017 | Sugahara et al. |
| 9,651,883 | B2 | 5/2017 | Hama et al. |
| 9,665,023 | B2 | 5/2017 | Kamae et al. |
| 9,665,026 | B2 | 5/2017 | Iwasaki et al. |
| 9,778,598 | B2 | 10/2017 | Onozaki et al. |
| 9,958,809 | B2 | 5/2018 | Sugahara et al. |
| 10,036,970 | B2 | 7/2018 | Kanno et al. |
| 10,082,743 | B2 | 9/2018 | Hama et al. |
| 10,146,146 | B2 | 12/2018 | Komatsu et al. |
| 10,175,595 | B2 | 1/2019 | Onozaki et al. |
| 2006/0093943 | A1 | 5/2006 | Shu et al. |
| 2009/0197190 | A1 | 8/2009 | Nakamura et al. |
| 2009/0233212 | A1 | 9/2009 | Fujikawa et al. |
| 2009/0246675 | A1 | 10/2009 | Nakamura et al. |
| 2010/0028796 | A1 | 2/2010 | Nakamura et al. |
| 2010/0183971 | A1 | 7/2010 | Fujikawa et al. |
| 2013/0244159 | A1 | 9/2013 | Ishigami et al. |
| 2013/0288173 | A1 | 10/2013 | Hashimoto et al. |
| 2014/0134535 | A1 | 5/2014 | Baba et al. |
| 2014/0329176 | A1 | 11/2014 | Kanno et al. |
| 2017/0315463 | A1 | 11/2017 | Onozaki et al. |
| 2017/0343911 | A1 | 11/2017 | Hashimoto et al. |
| 2018/0149992 | A1 | 5/2018 | Onozaki et al. |
| 2018/0246431 | A1 | 8/2018 | Hashimoto et al. |
| 2018/0259867 | A1 | 9/2018 | Sano et al. |
| 2018/0314176 | A1 | 11/2018 | Ikeda et al. |
| 2018/0356746 | A1 | 12/2018 | Hama et al. |

FOREIGN PATENT DOCUMENTS

| | | |
|---|---|---|
| JP | 2013-088482 | 5/2013 |
| JP | 2014-063155 | 4/2014 |
| WO | 92/019684 | 11/1992 |

TONER

BACKGROUND OF THE INVENTION

Field of the Invention

The present invention relates to the toner used in electrophotographic systems, electrostatic recording systems, and electrostatic printing systems.

Description of the Related Art

Accompanying the rapid spread of electrophotographic system-based color image-forming apparatuses, their applications have also become quite diversified and the requirements for greater image quality than in the past have been increasing as well.

For example, there has been broad penetration by full-color video communications accompanying the declining price of computer equipment targeted to personal users. Faithful reproduction even in finely detailed areas has also come to be required of the image-forming apparatuses, such as printers and copying machines that are an output means here.

In association with this, the requirements for bright colors have also been increasing and an expansion of the range of color reproduction is required.

Substantial advances have also recently been occurring in the printing sector, and an image quality—such as high precision, high definition, graininess, and so forth—equal to or higher than print quality is thus also being demanded of the images output with electrophotographic systems, while at the same time increases in the printing speed are being required.

Improvements in the printing speed, reductions in the running costs, and a stable image quality independent of the use environment are also being required at the same time, and a toner is desired that satisfies the properties required based on these diverse considerations.

In an electrophotographic system, in general an electrical latent image is formed on a photosensitive member; this latent image is developed with toner; the toner image is transferred to a medium such as paper; and fixing is subsequently performed by the application of heat and/or pressure by a fixing means to obtain an image.

Color reproduction is carried out in the case of full-color images using four toner colors, that is, toners in three chromatic colors, i.e., yellow toner, magenta toner, and cyan toner, which are the three primary colors of colored materials, along with a black toner.

With regard to magenta toner in particular, not only must yellow toner be added in order to reproduce red, which has a high human visual sensitivity, but an excellent developing performance is also required when reproducing the flesh tones in human images, which have complex color tones. In addition, cyan toner must be added in order to achieve the secondary color reproduction of blue, which is frequently used as a business color.

The tinting strength exhibited by the colorant in the toner must be increased in order to satisfy these requirements. As a consequence, when a pigment is used as a colorant, the pigment must be thoroughly microfine-sized and must be uniformly dispersed in the toner. The use of a highly chromogenic dye is another approach here.

A variety of pigments have been proposed for use in magenta toners. Among these, dimethylquinacridone, which is a quinacridone pigment, is frequently used for its excellent color vividness and excellent lightfastness. However, dimethylquinacridone does not have a very high tinting strength, and, in order to raise the tinting strength of the toner, its addition in large amounts to the toner has been proposed, as has its use in combination with other pigments.

The use, based on considerations of the color reproducibility and tinting strength, of quinacridone colorants and naphthol colorants, either individually or as mixtures, in conventional magenta toners is known.

A toner that uses quinacridone pigment is proposed in Japanese Patent Application Laid-open No. 2013-88482 as a magenta toner that uses an individual colorant. Toners that use monoazo-type naphthol pigments are proposed in Japanese Patent Application Laid-open No. 2005-107147 and Japanese Patent Application Laid-open No. 2006-133348. The use of a highly chromogenic dye is another approach. A toner that uses a methine dye as a colorant for magenta toner is proposed in Japanese Patent Application Laid-open No. 2014-63155.

SUMMARY OF THE INVENTION

However, it cannot be concluded that the colorants described in the aforementioned patent literature satisfy all of the conditions required of a toner. In particular, a problem has been that many pigments exhibit a poor dispersibility and as a consequence the dispersed particles end up causing light scattering, which facilitates reductions in the transparency, the color reproducibility, and the image density of the fixed image.

The present invention provides a toner that solves this problem. Specifically, the present invention provides a toner that exhibits an excellent color reproducibility and an excellent tinting strength.

The indicated problem can be solved by toner having the following constitution.

The present invention relates to a toner including: a toner particle, wherein the toner particle contains a binder resin, a compound represented by formula (1) below, and a compound in which at least a compound represented by formula (2) below and a compound represented by formula (3) below are in solid solution.

(1)

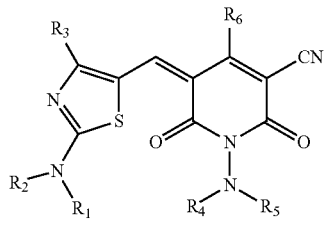

(2)

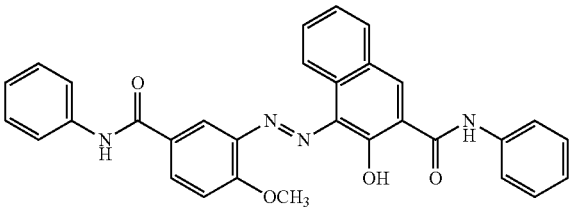

-continued (3)

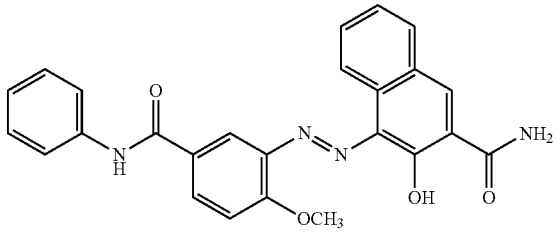

In formula (1), $R_1$, $R_2$, $R_3$, and $R_6$ each independently represent an alkyl group or aryl group, and $R_4$ and $R_5$ each independently represent an aryl group, acyl group, or alkyl group, or $R_4$ is bonded to $R_5$ to form a cyclic organic functional group that contains $R_4$, $R_5$, and the nitrogen atom to which $R_4$ and $R_5$ are bonded.

The present invention can thus provide a toner that exhibits an excellent color reproducibility and an excellent tinting strength.

Further features of the present invention will become apparent from the following description of exemplary embodiments.

DESCRIPTION OF THE EMBODIMENTS

Unless specifically indicated otherwise, the expressions "from XX to YY" and "XX to YY" that show numerical value ranges refer in the present invention to numerical value ranges that include the lower limit and upper limit that are the end points.

The toner of the present invention has a toner particle that contains a binder resin, a compound represented by formula (1) (also referred to in the following as compound (1)), and in addition a compound in which at least the compound represented by formula (2) (also referred to in the following as compound (2)) and the compound represented by formula (3) (also referred to in the following as compound (3)) are in solid solution.

The present inventors hold the following views with regard to the functions and effects brought about by this constitution.

The toner of the present invention contains the compound (1) and, in addition to the compound (1), a compound in which at least the compound (2) and the compound (3) are in solid solution, and it is thought that they interact.

The present inventors hypothesize that, due to these interactions, the dispersibility of compound (1) in the toner is enhanced and the tinting strength of the toner is substantially enhanced. The present inventors believe the reasons for this are as follows.

The surface of an organic pigment generally has a low polarity. Thus, while an organic pigment can have polar groups in the molecular structure of the pigment, when the pigment undergoes crystallization the molecules frequently engage in stacking centered on the interaction between the polar groups, and as a result little of the polar group is exposed at the pigment particle surface. Accordingly, the pigment surface, which presents few polar groups and is low energy, exhibits little adsorptive force to polar groups present in the dispersion medium, and as a consequence the ability to maintain a stable disperse state is impaired.

The compound (2) is a naphthol pigment and is a pigment with a relatively good dispersibility because it has the same amino structure for the phenyl group substituent at both ends. Moreover, in addition to having an excellent dispersibility itself, it readily functions as a pigment derivative that brings about an enhanced dispersibility for pigments used in combination therewith. In particular, due to the interaction between the phenyl group present at both ends of the compound (2) and the pyridone compound segment present in compound (1), the pigment dispersibility in the dispersion medium can be substantially enhanced when compound (1) and compound (2) are used in combination.

In addition, compound (2), because it has the same amino structure for the phenyl group substituent at both ends, exhibits a higher affinity for the ester bond moiety present in polyester resin than the heretofore used naphthol pigments. As a consequence, when a polyester resin is used for the binder resin, re-aggregation of the compound (2) is suppressed to an even better degree and the dispersibility of the pigment as a whole can be enhanced.

The present invention provides a toner with an excellent color reproducibility and tinting strength through the use of a compound in which the compound (2) and compound (3) are in solid solution. By bringing about this solid dissolution, these compounds reciprocally suppress crystal growth by each other and the solid-dissolved compounds are then more finely dispersed in the toner particle.

The present inventors believe that as a result the disperse state of the compound (1) is also improved, the chromogenicity possessed by each compound is maximized, and the color reproducibility and tinting strength of the toner is substantially enhanced.

The coloring compound represented by formula (1) is described first as follows.

The alkyl group encompassed by $R_1$, $R_2$, and $R_6$ in formula (1) is not particularly limited and can be exemplified by alkyl groups having 1 to 20 (preferably 1 to 15) carbon atoms and that may be saturated or unsaturated, linear, branched, or cyclic, and primary, secondary, or tertiary, e.g., the methyl group, ethyl group, n-propyl group, isopropyl group, n-butyl group, sec-butyl group, tert-butyl group, octyl group, dodecyl group, nonadecyl group, cyclobutyl group, cyclopentyl group, cyclohexyl group, methylcyclohexyl group, 2-ethylpropyl, 2-ethylhexyl group, and cyclohexenylethyl group. When, in particular, a branched alkyl group, e.g., the 2-ethylhexyl group, is used, an excellent dispersibility in the resin is provided and the color reproducibility of the toner is increased, and this is thus preferred.

The aryl group encompassed by $R_1$ and $R_2$ is not particularly limited and can be exemplified by the unsubstituted phenyl group and substituted phenyl groups. When an unsubstituted phenyl group or substituted phenyl group is used, a strong interaction is then provided with the compound in which at least compound (2) and compound (3) are in solid solution and the color reproducibility of the toner is increased, and this is thus preferred.

The substituents can be exemplified by alkyl groups having 1 to 6 (preferably 1 to 4) carbon atoms and alkoxy groups having 1 to 6 (preferably 1 to 4) carbon atoms.

The aryl group encompassed by $R_6$ in formula (1) is not particularly limited and can be exemplified by the phenyl group, methylphenyl group, and methoxyphenyl group.

When, in particular, $R_6$ is a primary, secondary, or tertiary alkyl group having 1 to 10 (preferably 1 to 7) carbon atoms, e.g., the methyl group, n-butyl group, 2-methylbutyl group, 2,3,3-trimethylbutyl group, and so forth, a strong interaction is then provided with the compound in which at least compound (2) and compound (3) are in solid solution and the color reproducibility of the toner is increased, and this is thus preferred.

The alkyl group encompassed by the $R_3$ in formula (1) is not particularly limited and can be exemplified by primary, secondary, and tertiary alkyl groups having 1 to 6 (preferably 1 to 4) carbon atoms, e.g., the methyl group, ethyl group, n-propyl group, isopropyl group, n-butyl group, sec-butyl group, t-butyl group, and so forth. In the particular case of the t-butyl group, which is a tertiary alkyl group, a strong interaction is provided with the compound in which at least compound (2) and compound (3) are in solid solution and the color reproducibility of the toner is increased, and this is thus preferred.

The aryl group encompassed by the $R_3$ in formula (1) is not particularly limited and is preferably, for example, a structure represented by the following formula (4).

(4)

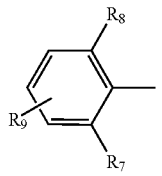

In formula (4), $R_7$ and $R_8$ each independently represent a hydrogen atom, an alkyl group having 1 to 6 (preferably 1 to 4) carbon atoms, or an alkoxy group having 1 to 6 (preferably 1 to 4) carbon atoms. $R_9$ represents a hydrogen atom, alkyl group, or alkoxy group.

The alkyl group encompassed by $R_7$ and $R_8$ in formula (4) is not particularly limited and can be exemplified by alkyl groups having 1 to 4 carbon atoms, e.g., the methyl group, ethyl group, n-propyl group, isopropyl group, n-butyl group, and so forth. The particular case of the methyl group provides an excellent compatibility with resins and an excellent lightfastness and is thus preferred.

The alkoxy group encompassed by $R_7$ and $R_8$ in formula (4) is not particularly limited and can be exemplified by the methoxy group, ethoxy group, n-propoxy group, isopropoxy group, n-butoxy group, isobutoxy group, sec-butoxy group, and tert-butoxy group.

The alkyl group encompassed by $R_9$ in formula (4) is not particularly limited and can be exemplified by alkyl groups having 1 to 20 (preferably 1 to 6 and more preferably 1 to 4) carbon atoms and that may be saturated or unsaturated, linear, branched, or cyclic, and primary, secondary, or tertiary, e.g., the methyl group, ethyl group, n-propyl group, isopropyl group, n-butyl group, sec-butyl group, tert-butyl group, octyl group, dodecyl group, nonadecyl group, cyclobutyl group, cyclopentyl group, cyclohexyl group, methylcyclohexyl group, 2-ethylpropyl group, 2-ethylhexyl group, and cyclohexenylethyl group.

The alkoxy group encompassed by $R_9$ in formula (4) is not particularly limited and can be exemplified by the methoxy group, ethoxy group, n-propoxy group, isopropoxy group, n-butoxy group, isobutoxy group, sec-butoxy group, and tert-butoxy group. An alkoxy group having 1 to 6 (more preferably 1 to 4) carbon atoms is preferred.

The alkyl group encompassed by $R_4$ and $R_5$ in formula (1) is not particularly limited and can be exemplified by alkyl groups having 1 to 20 (preferably 1 to 6 and more preferably 1 to 4) carbon atoms and that may be saturated or unsaturated, linear, branched, or cyclic, and primary, secondary, or tertiary, e.g., the methyl group, ethyl group, n-propyl group, isopropyl group, n-butyl group, sec-butyl group, tert-butyl group, octyl group, dodecyl group, nonadecyl group, cyclobutyl group, cyclopentyl group, cyclohexyl group, methylcyclohexyl group, 2-ethylpropyl, 2-ethylhexyl group, and cyclohexenylethyl group.

The acyl group encompassed by $R_4$ and $R_5$ in formula (1) is not particularly limited and can be exemplified by the formyl group, substituted and unsubstituted alkylcarbonyl groups having 2 to 30 (preferably 2 to 10 and more preferably 2 to 4) carbon atoms, substituted and unsubstituted arylcarbonyl groups having 7 to 30 (preferably 7 to 11) carbon atoms, and heterocyclic carbonyl groups. Specific examples are the acetyl group, propionyl group, pivaloyl group, benzoyl group, naphthoyl group, 2-pyridylcarbonyl group, and 2-furylcarbonyl group. The substituents can be exemplified by alkyl groups and alkoxy groups (for example, having 1 to 4 carbon atoms).

The aryl group encompassed by $R_4$ and $R_5$ in formula (1) is not particularly limited and can be exemplified by substituted and unsubstituted aryl groups having 6 to 10 carbon atoms. The substituents can be exemplified by alkyl groups and alkoxy groups (for example, having 1 to 4 carbon atoms). When a substituent is present, the number of carbon atoms indicated in the preceding indicates a number that includes the number of carbon atoms in the substituent. In addition, a single substituent or a plurality of substituents may be present. Specific examples are the phenyl group, 4-methylphenyl group, and 4-methoxyphenyl group.

There are no particular limitations on the cyclic organofunctional group formed by the bonding of $R_4$ to $R_5$ and containing $R_4$ and $R_5$ and the nitrogen atom to which $R_4$ and $R_5$ are bonded, and examples are the piperidinyl group, piperazinyl group, and morpholino group.

In particular, preferably at least either of $R_4$ and $R_5$ is an alkyl group because this provides an excellent compatibility with resins and an excellent lightfastness. The methyl group is particularly preferred.

Preferably $R_1$ and $R_2$ are each independently an alkyl group having 1 to 15 carbon atoms; $R_3$ is an alkyl group having 1 to 6 carbon atoms or the group represented by formula (4); $R_6$ is an alkyl group having 1 to 10 carbon atoms; and $R_4$ and $R_5$ are each independently an alkyl group having 1 to 6 carbon atoms, an alkylcarbonyl group having 2 to 10 carbon atoms, or an arylcarbonyl group having 7 to 11 carbon atoms.

The coloring compound represented by formula (1) can be synthesized with reference to the known method described in WO 92/19684.

An embodiment is provided below of a method for producing the coloring compound having the structure represented by formula (1), but this should not be taken to mean that the production method is limited to or by this.

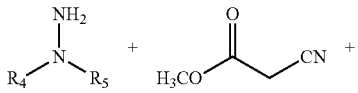

hydrazine compound methyl acetate compound

-continued

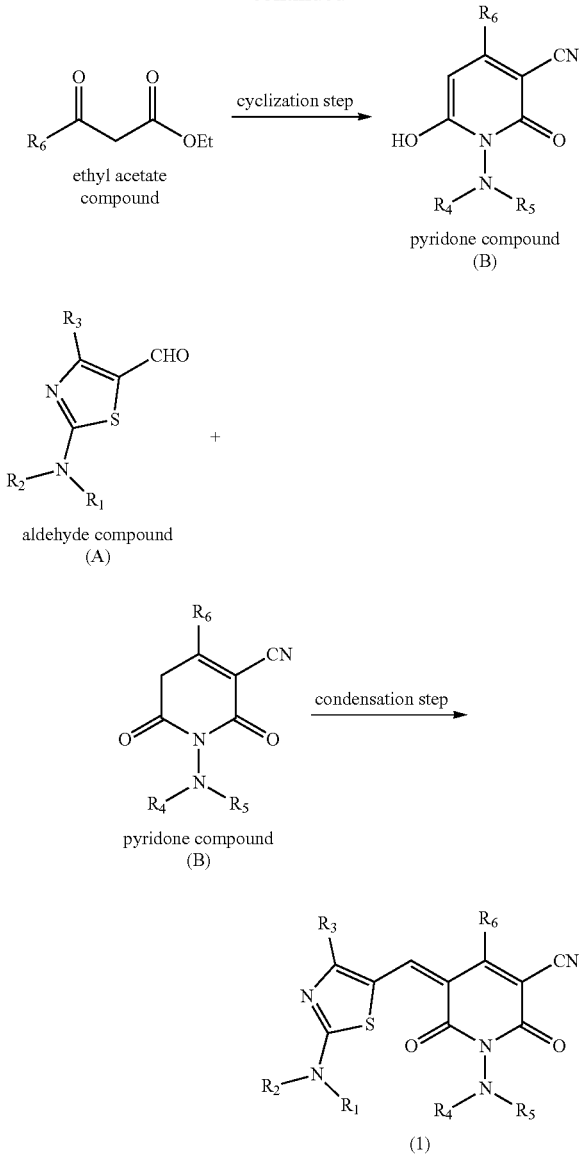

The $R_1$ to $R_6$ in the individual compounds in the reaction formulas and in the coloring compound with the structure represented by formula (1) have the same definitions as already provided above. Formula (1) does have cis-trans structural isomers, but both are encompassed by the present invention. While the structures of the pyridone compound (B) in the two reaction formulas are different, the two are isomers in an equilibrium relationship and indicate substantially the same compound.

The coloring compound represented by formula (1) can be produced by condensation between the aldehyde compound (A) and the pyridone compound (B).

The aldehyde compound (A) can be synthesized with reference to the known method described in WO 92/19684.

Aldehyde compounds (1) to (5) are provided below as preferred examples of the aldehyde compound (A), but there is no limitation to the following compounds.

(1)

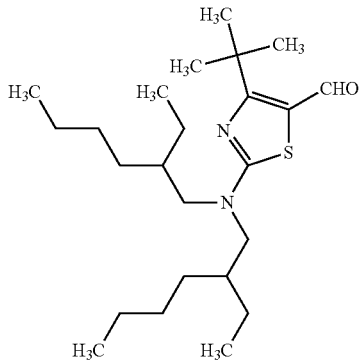

(2)

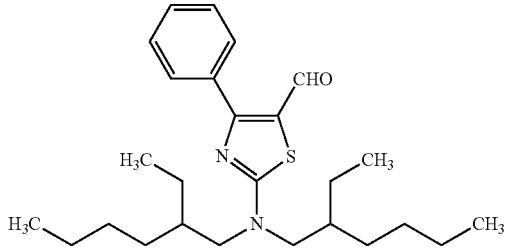

(3)

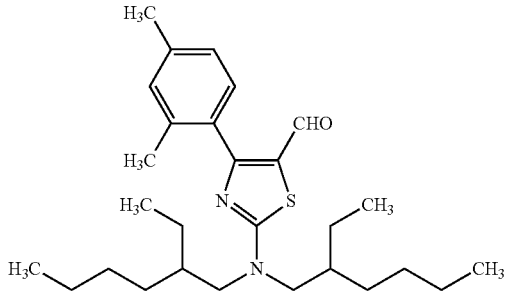

(4)

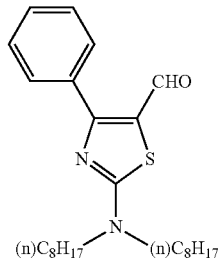

(5)

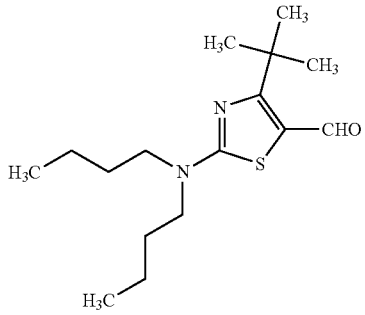

The cyclization step for obtaining the pyridone compound (B) will now be described.

The pyridone compound (B) can be synthesized by a cyclization step in which the three components, i.e., the hydrazine compound, the methyl acetate compound, and the ethyl acetate compound, are coupled.

This cyclization step may be run in the absence of solvent, but is preferably run in the presence of a solvent. The solvent should not participate in the reaction, but is not otherwise particularly limited and can be exemplified by water, methanol, ethanol, acetic acid, and toluene. A mixture of two or more solvents may also be used, and the mixing ratio when a mixture is used may be freely established. The amount of use of the reaction solvent, considered per 100 mass parts of the methyl acetate compound, is preferably in the range from 0.1 to 1,000 mass parts and is more preferably 1.0 to 150 mass parts.

The use of a base in this cyclization step is preferred since the use of a base causes the reaction to proceed rapidly. The base that can be used here can be specifically exemplified by organic bases such as pyridine, 2-methylpyridine, diethylamine, diisopropylamine, triethylamine, phenyl ethyl amine, isopropylethylamine, methylaniline, 1,4-diazabicyclo[2.2.2]octane, tetrabutylammonium hydroxide, 1,8-diazabicyclo[5.4.0]undecene, and potassium acetate; organometals such as n-butyllithium and tert-butylmagnesium chloride; inorganic bases such as sodium borohydride, sodium metal, potassium hydride, and calcium oxide; and metal alkoxides such as potassium tert-butoxide, sodium tert-butoxide, and sodium ethoxide.

Among the preceding, triethylamine and piperidine are preferred with triethylamine being more preferred. The use amount for the base, expressed per 100 mass parts of the methyl acetate compound, is preferably 0.01 to 100 mass parts, more preferably 0.1 to 20 mass parts, and still more preferably in the range from 0.5 to 5 mass parts. After the completion of the reaction, the desired pyridone compound can be obtained by purification by, for example, distillation, recrystallization, silica gel chromatography, and so forth.

Pyridone compounds (1) to (6) are provided below as preferred examples of the pyridone compound (B), but there is no limitation to the following compounds.

(1)

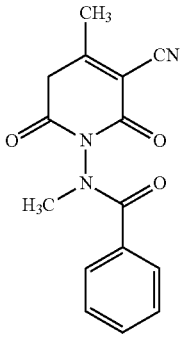

-continued (2)

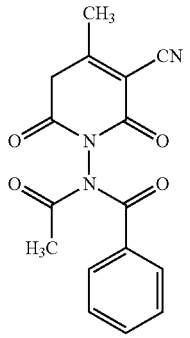

(3)

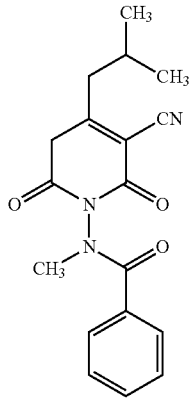

(4)

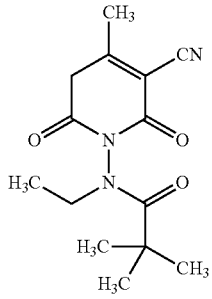

(5)

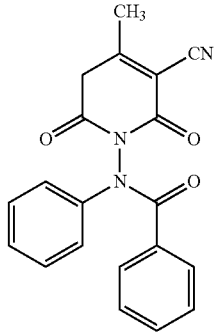

(6)

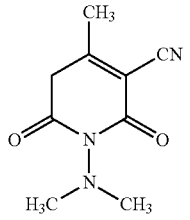

The condensation step, which yields the coloring compound represented by formula (1), is described in the following.

The coloring compound represented by formula (1) can be synthesized by a condensation step in which the aldehyde compound (A) is condensed with the pyridone compound (B).

This condensation step may be run in the absence of solvent, but is preferably run in the presence of a solvent. The solvent should not participate in the reaction, but is not otherwise particularly limited and can be exemplified by chloroform, dichloromethane, N,N-dimethylformamide, toluene, xylene, tetrahydrofuran, dioxane, acetonitrile, ethyl acetate, methanol, ethanol, and isopropanol. A mixture of two or more solvents may also be used, and the mixing ratio when a mixture is used may be freely established. The amount of use of the reaction solvent, considered per 100 mass parts of the aldehyde compound, is preferably in the range from 0.1 to 1,000 mass parts and is more preferably 1.0 to 150 mass parts.

The reaction temperature in this condensation step is preferably in the range from −80° C. to 250° C. and is more preferably −20° C. to 150° C. The reaction in this condensation step is generally complete in within 24 hours.

The reaction in this condensation step proceeds rapidly when an acid or base is used, which is thus preferred.

Usable acids can be specifically exemplified by inorganic acids such as hydrochloric acid, sulfuric acid, and phosphoric acid; organic acids such as p-toluenesulfonic acid, formic acid, acetic acid, propionic acid, and trifluoroacetic acid; and inorganic salts such as ammonium formate and ammonium acetate. Among these, p-toluenesulfonic acid, ammonium formate, and ammonium acetate are preferred. The use amount of this acid, expressed per 100 mass parts of the aldehyde compound, is preferably 0.01 to 20 mass parts and more preferably is in the range from 0.1 to 5 mass parts.

Usable bases can be specifically exemplified by organic bases such as pyridine, 2-methylpyridine, diethylamine, diisopropylamine, triethylamine, phenylethylamine, isopropylethylamine, methylaniline, 1,4-diazabicyclo[2.2.2]octane, tetrabutylammonium hydroxide, 1,8-diazabicyclo[5.4.0]undecene, and potassium acetate; organometals such as n-butyllithium and tert-butylmagnesium chloride; inorganic bases such as sodium borohydride, sodium metal, potassium hydride, and calcium oxide; and metal alkoxides such as potassium tert-butoxide, sodium tert-butoxide, and sodium ethoxide.

Among the preceding, triethylamine and piperidine are preferred, while triethylamine is more preferred. The amount of use of this base, expressed per 100 mass parts of the aldehyde compound, is preferably 0.1 to 20 mass parts and is more preferably in the range from 0.2 to 5 mass parts.

The resulting coloring compound represented by formula (1) is worked up using the usual work-up procedures for organic synthesis reactions. The high-purity coloring compound can then be obtained by carrying out purification such as a liquid separation procedure, recrystallization, reprecipitation, and column chromatography.

A single coloring compound with formula (1) or a combination of two or more may be used to adjust, for example, the color tone, in conformity with the goal of the use application. Combinations of two or more known pigments and/or dyes may also be used.

Compounds (1)-A to (1)-F are provided below as preferred examples of the compound with formula (1), but there is no limitation to the following compounds.

(1) - A

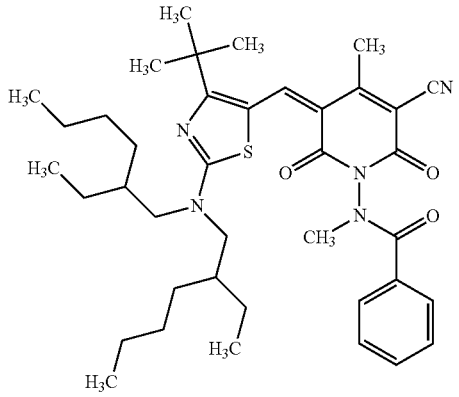

(1) - B

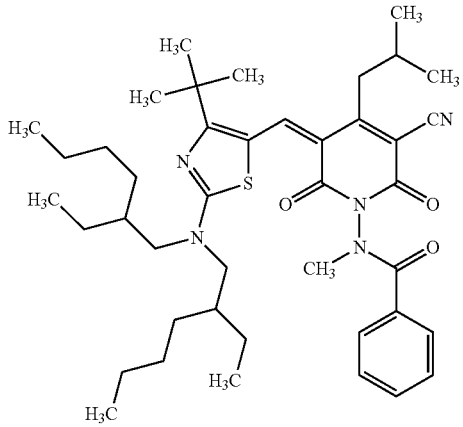

(1) - C

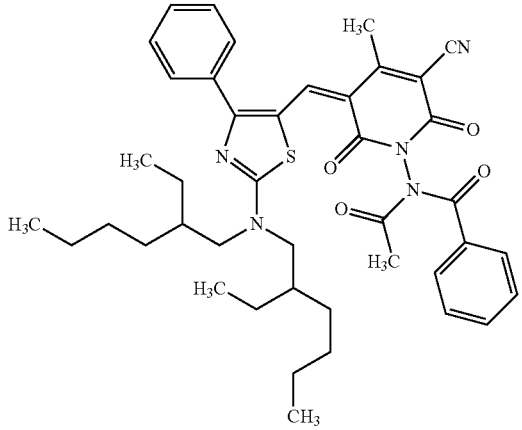

(1) - D

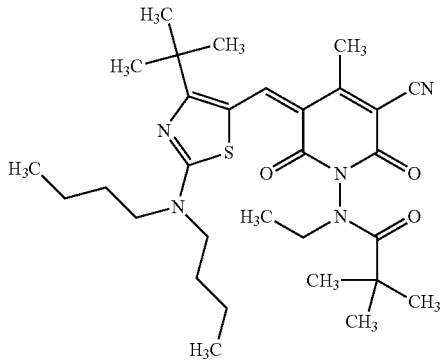

-continued (1) - E

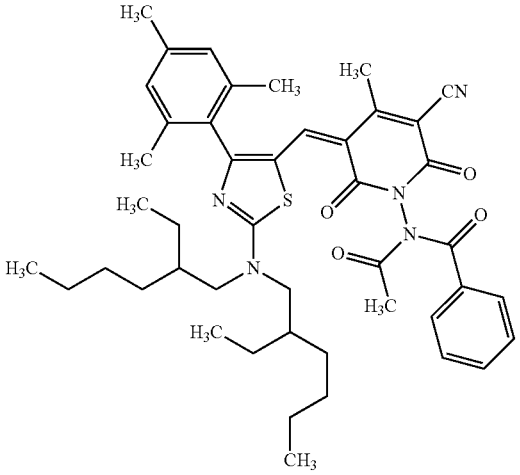

(1) - F

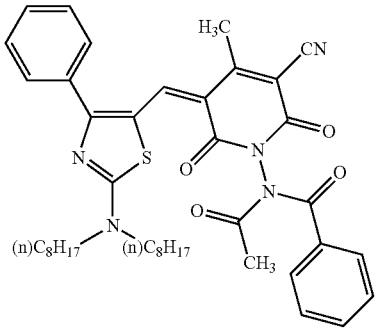

In addition to the compound (1) and the compound in which at least the compound (2) and compound (3) are in solid solution, naphthol compounds, quinacridone compounds, and their lake compounds, as described in the following, may also be used in the present invention.

The naphthol compounds can be exemplified by C. I. Pigment Red 31, 147, 150, 184, 238, and 269.

The quinacridone compounds can be exemplified by C. I. Pigment Red 122, 192, and 282 and by C. I. Pigment Violet 19.

Examples of lake compounds of naphthol compounds and quinacridone compounds are C. I. Pigment Red 48:2, 48:3, 48:4, and 57:1. Compounds selected from naphthol compounds and quinacridone compounds are preferred, while compounds selected from naphthol pigments and quinacridone pigments are more preferred.

In the present invention, a solid solution of the compound (2) and compound (3) represented by the following formulas is co-used in order to further strengthen the interaction with compound (1) and raise the dispersibility in the toner particle. The color reproducibility and tinting strength of the toner can be further increased by the co-use of this solid solution.

(2)

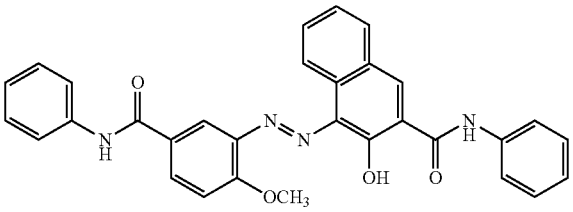

(3)

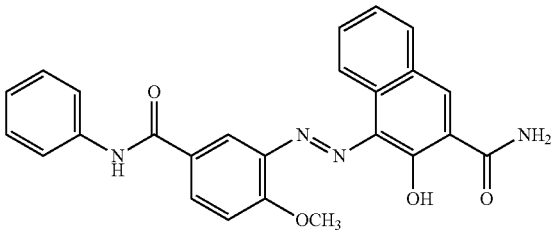

Another compound may also be solid dissolved in the compound in which the compound (2) and compound (3) are solid dissolved.

This additional compound is preferably a naphthol compound and can be exemplified by compounds represented by the following formula (I). That is, the compound in which the compound (2) and the compound (3) are in solid solution may be a compound in which the compound (2), the compound (3), and a compound with formula (I) below are in solid solution.

(I)

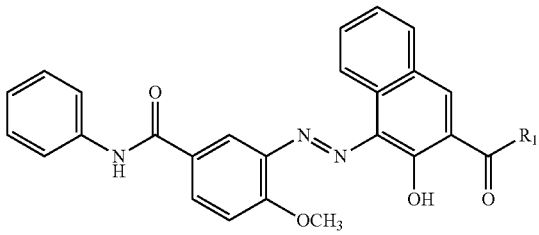

(I-2)

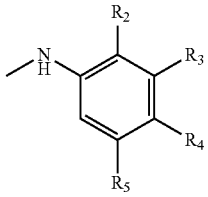

($R_1$ in formula (I) represents —$NH_2$ or the group with the formula (I-2). In formula (I-2), $R_2$ to $R_5$ each independently represent a hydrogen atom, chlorine atom, —$NO_2$, an alkyl group having 1 to 4 carbon atoms (more preferably the methyl group), or an alkoxy group having 1 to 4 carbon atoms (more preferably the methoxy group), but excluding the case in which $R_2$ to $R_5$ are all a hydrogen atom.)

The compound (2) and compound (3) must be solid dissolved and must be present in a mixed crystal state in the toner particle.

A known method can be used to effect solid dissolution of the compounds. Examples in this regard are as follows:

(1) a method in which crude crystals of two or more compounds are mixed and an acid paste treatment is carried out and, after microfine crystals have been obtained, a crystal growth treatment is performed in an organic solvent having a high dielectric constant;

(2) a method in which crude crystals of two or more compounds are mixed and ball milling is performed with sodium chloride; and (3) a method in which the aromatic amine of two or more compounds is converted into the diazonium salt and a coupling reaction is subsequently run in, for example, an aqueous sodium hydroxide solution.

The content of the compound (1) in the toner, expressed per 100 mass parts of the binder resin, is preferably from 0.5 mass parts to 20.0 mass parts and is more preferably from 1.0 mass parts to 3.0 mass parts. Bringing the amount of addition into the indicated range can provide an excellent hot offset resistance during fixing, an excellent color reproducibility, and an excellent tinting strength.

The content of the compound (2), expressed per 100 mass parts of the binder resin, is preferably from 0.2 mass parts to 10.0 mass parts and is more preferably from 0.5 mass parts to 2.0 mass parts.

The content of the compound (3), expressed per 100 mass parts of the binder resin, is preferably from 0.2 mass parts to 10.0 mass parts and is more preferably from 0.5 mass parts to 2.0 mass parts. Bringing the amount of addition into the indicated range can provide an even better color reproducibility and tinting strength for the toner.

In addition, preferably the following formula is satisfied where A is the content (mass parts) of the compound (1) and B is the content (mass parts) of the compound in which at least the compound (2) and the compound (3) are in solid solution.

$$0.005 \leq A/B \leq 10.000$$

By satisfying this formula, the dispersibility of compound (1) in the toner can be further improved and a toner exhibiting a high tinting strength and a high color reproducibility can be obtained. A/B is more preferably from 0.05 to 5.00 and still more preferably from 0.10 to 5.00.

The compound, in accordance with the present invention, in which compound (2) and compound (3) are in solid solution may be treated with a surface treatment agent or rosin compound using a heretofore known method. In particular, treatment with a rosin compound prevents pigment re-aggregation and because of this can improve the dispersibility of the pigment in the toner particle and can also bring the charging performance of the toner into a preferred state.

The rosin compound can be exemplified by natural rosins such as tall oil rosin, gum rosin, and wood rosin; modified rosins such as hydrogenated rosin, disproportionated rosin, and polymerized rosin; synthetic rosins such as styrene-acrylic rosin; and also the alkali metal salts and ester compounds of these rosins.

In particular, abietic acid, tetrahydroabietic acid, neoabietic acid, dehydroabietic acid, dihydroabietic acid, pimaric acid, isopimaric acid, levopimaric acid, palustric acid, and their alkali metal salts and ester compounds are preferred from the standpoint of compatibility with the binder resin and provide an improved pigment dispersibility and an enhanced chromogenicity for the toner.

Methods for treating the colorant with the aforementioned rosin compounds can be exemplified by (1) a dry mixing method, in which the rosin compound is dry mixed with the colorant followed as necessary by the execution of a heat treatment, e.g., melt-kneading. Another example is (2) a wet treatment method, in which an aqueous alkali solution of the rosin is added to the colorant synthesis solution during colorant production, followed by the execution of a process of coating the colorant surface by adding a laking metal salt, e.g., of calcium, barium, strontium, or manganese, and insolubilizing the rosin.

The extent of treatment of the colorant with the rosin compound should provide an amount of the rosin compound in the colorant (colorant composition) of generally 1 to 40 mass %, preferably 5 to 30 mass %, and more preferably 10 to 20 mass %. The aforementioned properties can be brought to even better levels by using the indicated extent of treatment.

The content in the toner of the present invention of the compound in which compound (2) and compound (3) are in solid solution, expressed per 100 mass parts of the binder resin, is preferably from 0.5 mass parts to 20.0 mass parts. The content is more preferably from 1.0 mass parts to 3.0 mass parts. The hot offset resistance during fixing is improved when this content is at least 0.5 mass %. At 20.0 mass parts and below, aggregation of the pigment in the toner can be inhibited and a smaller toner laid-on level on the paper is required to output an image having a desired density. The color reproducibility range can be broadened as a result.

The content of the colorant in the toner according to the present invention, expressed per 100 mass parts of the binder resin, is preferably from 3.0 mass parts to 20.0 mass parts and is more preferably from 5.0 mass parts to 15.0 mass parts. A colorant content of at least 3.0 mass parts provides a favorable toner laid-on level on the paper in order to output an image having a desired density. At 20.0 mass parts and below, pigment aggregation is inhibited, the color is resistant to muddying, and the color reproducibility range is readily broadened.

The Binder Resin

There are no particular limitations on the binder resin used in the toner according to the present invention, and the following polymers and resins can be used.

The following, for example, can be used: homopolymers of styrene and its substituted forms, e.g., polystyrene, poly-p-chlorostyrene, and polyvinyltoluene; styrene copolymers, e.g., styrene-p-chlorostyrene copolymer, styrene-vinyltoluene copolymer, styrene-vinylnaphthalene copolymer, styrene-acrylate ester copolymers, styrene-methacrylate ester copolymers, styrene-methyl α-chloromethacrylate copolymer, styrene-acrylonitrile copolymer, styrene-vinyl methyl ether copolymer, styrene-vinyl ethyl ether copolymer, styrene-vinyl methyl ketone copolymer, and styrene-acrylonitrile-indene copolymer; as well as polyvinyl chloride, phenolic resins, natural resin-modified phenolic resins, natural resin-modified maleic acid resins, acrylic resins, methacrylic resins, polyvinyl acetate, silicone resins, polyester resins, polyurethane resins, polyamide resins, furan resins, epoxy resins, xylene resins, polyvinyl butyral, terpene resins, coumarone-indene resins, and petroleum resins.

Polyester resins and styrene copolymers are preferred among the preceding.

The binder resin preferably comprises a polyester resin from the standpoint of the pigment dispersibility, fixing performance, and developing stability. The content of the polyester resin in the overall binder resin is preferably from 50 mass % to 100 mass % and is more preferably from 70 mass % to 100 mass %.

A polyester resin is a resin that has a "polyester unit" in the resin chain. The components constituting this polyester unit are specifically an at least dihydric alcohol component and an acid monomer component, e.g., an at least dibasic carboxylic acid, an at least dibasic carboxylic acid anhydride, esters of at least dibasic carboxylic acids, and so forth.

The at least dihydric alcohol component can be exemplified by the following: alkylene oxide adducts on bisphenol A, e.g., polyoxypropylene(2.2)-2,2-bis(4-hydroxyphenyl) propane, polyoxypropylene(3.3)-2,2-bis(4-hydroxyphenyl) propane, polyoxyethylene(2.0)-2,2-bis(4-hydroxyphenyl) propane, polyoxypropylene(2.0)-polyoxyethylene(2.0)-2,2-bis(4-hydroxyphenyl)propane, and polyoxypropylene(6)-2,2-bis(4-hydroxyphenyl)propane, as well as ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Among the preceding, aromatic diol is preferably used for the alcohol monomer component, and the alcohol monomer component constituting the polyester resin preferably contains aromatic diol in a proportion of from 80 mol % to 100 mol %.

On the other hand, the following are examples of the acid monomer component, e.g., an at least dibasic carboxylic acid, an at least dibasic carboxylic acid anhydride, esters of at least dibasic carboxylic acids, and so forth: aromatic dicarboxylic acids such as phthalic acid, isophthalic acid, and terephthalic acid and their anhydrides; alkyl dicarboxylic acids such as succinic acid, adipic acid, sebacic acid, and azelaic acid and their anhydrides; succinic acid substituted by an alkyl group or alkenyl group having 6 to 18 carbon atoms, and anhydrides thereof; and unsaturated dicarboxylic acids such as fumaric acid, maleic acid, and citraconic acid and their anhydrides.

Among the preceding, polybasic carboxylic acids, e.g., terephthalic acid, succinic acid, adipic acid, fumaric acid, trimellitic acid, pyromellitic acid, benzophenonetetracarboxylic acid, and their anhydrides, are preferred for use as the acid monomer component.

The acid value of the polyester resin is preferably not more than 20 mg KOH/g from the standpoint of the pigment dispersibility and developing stability. Not more than 15 mg KOH/g is more preferred. While there is no particular limitation on the lower limit, the lower limit is preferably at least 1 mg KOH/g and is more preferably at least 3 mg KOH/g.

When the acid value is not more than 20 mg KOH/g, an excellent pigment dispersibility is obtained and the fixing performance and developing performance are increased.

The acid value can be brought into the indicated range by adjusting the type and proportions of the monomers used for the resin. Specifically, the acid value can be controlled by adjusting the molecular weight and the alcohol monomer component/acid monomer component ratio during resin production. The acid value can also be controlled by reacting, after the ester condensation polymerization, the terminal alcohol with a polybasic acid monomer (for example, trimellitic acid).

Resin Composition Having a Structure in Which a Vinyl Resin Component is Reacted with a Hydrocarbon Compound The toner particle may optionally contain a resin composition having a structure in which a vinyl resin component is reacted with a hydrocarbon compound. The incorporation of this resin composition can bring about a more uniform microfine dispersion of the pigment and wax in the toner.

The following are particularly preferred for this resin composition having a structure in which a vinyl resin component is reacted with a hydrocarbon compound: graft polymers having a structure in which a polyolefin is grafted onto a vinyl resin component and/or graft polymers having a structure in which a vinyl monomer is graft polymerized on a polyolefin.

This resin composition having a structure in which a vinyl resin component is reacted with a hydrocarbon compound acts like a surfactant relative to the wax and binder resin melted during the kneading step and surface smoothing step carried out during toner production. Accordingly, this resin composition is preferred because it enables control of the average dispersed primary particle diameter of the wax in the resin and because it enables control of the degree of migration by the wax to the toner surface when an optional surface treatment with a hot air current is carried out.

With regard to the graft polymer here, the polyolefin should be a polymer or copolymer of unsaturated hydrocarbon monomer having a single double bond, but is not otherwise particularly limited and various polyolefins can be used. The use of a polyethylene or a polypropylene is particularly preferred.

The vinyl monomer used in the vinyl resin component, on the other hand, can be exemplified by the following.

Styrenic monomers, e.g., styrene and its derivatives, such as styrene, o-methylstyrene, m-methyl styrene, p-methyl styrene, p-methoxystyrene, p-phenyl styrene, p-chlorostyrene, 3,4-dichlorostyrene, p-ethyl styrene, 2,4-dimethyl styrene, p-n-butylstyrene, p-tert-butyl styrene, p-n-hexyl styrene, p-n-octylstyrene, p-n-nonylstyrene, p-n-decylstyrene, and p-n-dodecylstyrene.

Amino group-bearing esters of α-methylene aliphatic monocarboxylic acids, such as dimethylaminoethyl methacrylate and diethylaminoethyl methacrylate; and nitrogen atom-containing vinyl monomers, e.g., acrylic acid derivatives and methacrylic acid derivatives, such as acrylonitrile, methacrylonitrile, and acrylamide.

Carboxyl group-containing vinyl monomers such as unsaturated dibasic acids, e.g., maleic acid, citraconic acid, itaconic acid, alkenylsuccinic acid, fumaric acid, and mesaconic acid; unsaturated dibasic acid anhydrides such as maleic anhydride, citraconic anhydride, itaconic anhydride, and alkenylsuccinic anhydride; the half esters of unsaturated dibasic acids, such as monomethyl maleate, monoethyl maleate, monobutyl maleate, monomethyl citraconate, monoethyl citraconate, monobutyl citraconate, monomethyl itaconate, monomethyl alkenyl succinate, monomethyl fumarate, and monomethyl mesaconate; the esters of unsaturated dibasic acids, such as dimethyl maleate and dimethyl fumarate; α,β-unsaturated acids such as acrylic acid, methacrylic acid, crotonic acid, and cinnamic acid; the anhydrides of α,β-unsaturated acids, such as crotonic anhydride and cinnamic anhydride; the anhydrides between an α,β-unsaturated acid and a lower fatty acid; as well as alkenylmalonic acid, alkenylglutaric acid, and alkenyladipic acid and their anhydrides and monoesters.

Hydroxyl group-containing vinyl monomers, e.g., acrylate and methacrylate esters such as 2-hydroxyethyl acrylate, 2-hydroxyethyl methacrylate, and 2-hydroxypropyl methacrylate, as well as 4-(1-hydroxy-1-methylbutyl)styrene and 4-(1-hydroxy-1-methylhexyl)styrene.

Ester units comprising an acrylate ester, e.g., acrylate esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate. Ester units comprising a methacrylate ester, e.g., α-methylene aliphatic monocarboxylic acid esters, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate.

The resin composition having a structure in which a vinyl resin component is reacted with a hydrocarbon compound can be obtained by known methods, e.g., the reaction of their monomers, supra, with each other, the reaction of monomer for one of the polymers with the other polymer, and so forth.

The structural units of the vinyl resin component preferably include a styrenic unit and also acrylonitrile or methacrylonitrile.

The mass ratio between the hydrocarbon compound and the vinyl resin component (hydrocarbon compound/vinyl resin component) in this resin composition is preferably 1/99 to 75/25. The use of the hydrocarbon compound and vinyl resin component in this range is preferred for bringing about dispersion of the pigment in the toner particle.

The content of this resin composition having a structure in which a vinyl resin component is reacted with a hydrocarbon compound, expressed per 100 mass parts of the binder resin, is preferably from 0.2 mass parts to 20 mass parts and is more preferably from 3.0 mass parts to 10 mass parts.

The weight-average molecular weight (Mw) of this resin composition is preferably from 6,000 to 8,000, and its number-average molecular weight (Mn) is preferably from 1,500 to 5,000.

The use of this resin composition in the indicated range is preferred for bringing about dispersion of the pigment in the toner particle.

The Wax

The toner may contain a wax. Hydrocarbon waxes are preferred for the wax.

There are no particular limitations on the hydrocarbon wax, and it can be exemplified by the following: hydrocarbon waxes such as low molecular weight polyethylene, low molecular weight polypropylene, alkylene copolymers, microcrystalline wax, paraffin wax, and Fischer-Tropsch waxes; oxides of hydrocarbon waxes, such as oxidized polyethylene wax, and their block copolymers; waxes in which the major component is fatty acid ester, such as carnauba wax; and waxes provided by the partial or complete deacidification of fatty acid esters, such as deacidified carnauba wax.

Additional examples of the wax are as follows: saturated straight-chain fatty acids such as palmitic acid, stearic acid, and montanic acid; unsaturated fatty acids such as brassidic acid, eleostearic acid, and parinaric acid; saturated alcohols such as stearyl alcohol, aralkyl alcohols, behenyl alcohol, carnaubyl alcohol, ceryl alcohol, and melissyl alcohol; polyhydric alcohols such as sorbitol; esters between a fatty acid such as palmitic acid, stearic acid, behenic acid, or montanic acid and an alcohol such as stearyl alcohol, aralkyl alcohol, behenyl alcohol, carnaubyl alcohol, ceryl alcohol, or melissyl alcohol; fatty acid amides such as linoleamide, oleamide, and lauramide; saturated fatty acid bisamides such as methylenebisstearamide, ethylenebiscapramide, ethylenebislauramide, and hexamethylenebisstearamide; unsaturated fatty acid amides such as ethylenebisoleamide, hexamethylenebisoleamide, N,N'-dioleyladipamide, and N,N'-dioleylsebacamide; aromatic bisamides such as m-xylenebisstearamide and N,N'-distearylisophthalamide; fatty acid metal salts (generally known as metal soaps) such as calcium stearate, calcium laurate, zinc stearate, and magnesium stearate; waxes provided by grafting an aliphatic hydrocarbon wax using a vinyl monomer such as styrene or acrylic acid; partial esters between a fatty acid and a polyhydric alcohol, such as behenyl monoglyceride; and hydroxy group-containing methyl ester compounds obtained by the hydrogenation of plant oils.

Paraffin waxes and Fischer-Tropsch waxes are preferred among the preceding waxes from the standpoint of enhancing the color reproducibility.

The content of the wax, per 100 mass parts of the binder resin, is preferably from 0.5 mass parts to 20.0 mass parts and is more preferably from 3.0 mass parts to 12.0 mass parts.

Viewed from the standpoint of having the storability and hot offset of the toner coexist with each other in good balance, the peak temperature of the maximum endothermic peak present in the temperature range from 30° C. to 200° C. in the endothermic curve during ramp up as measured with a differential scanning calorimeter (DSC) is preferably from 50° C. to 110° C. The peak temperature is more preferably from 70° C. to 100° C.

The Charge Control Agent

A charge control agent may also be incorporated in the toner on an optional basis. A known charge control agent can be used for the charge control agent incorporated in the toner, but metal compounds of aromatic carboxylic acids that are colorless, provide a high toner charging speed, and can maintain a stable and constant amount of charge are particularly preferred.

Negative-charging charge control agents can be exemplified by metal salicylate compounds, metal naphthoate compounds, metal dicarboxylate compounds, polymer compounds having sulfonic acid or carboxylic acid in side chain position, polymer compounds having a sulfonate salt or sulfonate ester in side chain position, polymer compounds having a carboxylate salt or carboxylate ester in side chain position, boron compounds, urea compounds, silicon compounds, and calixarene. The charge control agent may be internally added or externally added to the toner particle.

The amount of charge control agent addition is preferably from 0.2 mass parts to 10 mass parts per 100 mass parts of the binder resin.

The External Additive

An external additive may also be added to the toner particle on an optional basis in the present invention for the purpose of enhancing the flowability and adjusting the triboelectric charge quantity.

An inorganic fine particle, e.g., of silica, titanium oxide, aluminum oxide, or strontium titanate, is preferred for this external additive. This inorganic fine particle is preferably subjected to a hydrophobic treatment with a hydrophobic agent such as a silane compound, silicone oil, or their mixture.

From the standpoint of preventing the external agent from becoming buried, an inorganic fine particle having a specific surface area of from 10 $m^2/g$ to 50 $m^2/g$ is preferred for the external additive that is used.

The external additive is preferably used at from 0.1 mass parts to 5.0 mass parts per 100 mass parts of the toner particle.

The toner particle can be mixed with the external additive using a known mixer such as a Henschel mixer, but the device is not particularly limited as long as mixing can be carried out.

Viewed from the standpoint of obtaining a stable image on a long-term basis, the toner according to the present invention is preferably used in the form of a two-component developer as obtained by mixing with a magnetic carrier.

A generally known magnetic carrier can be used for the magnetic carrier here, and examples in this regard are magnetic bodies such as surface-oxidized iron powder; nonoxidized iron powder; metal particles such as those of iron, lithium, calcium, magnesium, nickel, copper, zinc, cobalt, manganese, and rare earths, as well as their alloy particles and oxide particles; and ferrite. Additional examples are magnetic body-dispersed resin carriers (referred to as resin carriers), which contain a magnetic body and a binder resin that holds this magnetic body in a dispersed state.

The Production Method

There are no particular limitations on the method for producing the toner according to the present invention, and known production methods can be used. A toner production method using a pulverization procedure is provided as an example and is described herebelow.

In the starting material mixing step, the starting materials for the toner particle, for example, the binder resin, colorant, and wax and other optional components such as the resin composition, charge control agent, and so forth, are metered out in prescribed amounts and are blended and mixed. The mixing apparatus can be exemplified by the double-cone mixer, V-mixer, drum mixer, Supermixer, Henschel mixer, Nauta mixer, Mechano Hybrid (Nippon Coke & Engineering Co., Ltd.), and so forth.

The mixed material is then melt-kneaded to disperse the colorant, wax, and so forth in the binder resin. The melt-kneading step can use a batch kneader such as a pressure kneader or a Banbury mixer or can use a continuous kneader. Single-screw and twin-screw extruders are the mainstream here for the advantage they offer of enabling continuous production. Examples in this regard are the KTK twin-screw extruder (Kobe Steel, Ltd.), TEM twin-screw extruder (Toshiba Machine Co., Ltd.), PCM kneader (Ikegai Corp.), Twin Screw Extruder (KCK), Co-Kneader (Buss), and Kneadex (Nippon Coke & Engineering Co., Ltd.). The resin composition yielded by melt-kneading may be rolled using, for example, a two-roll mill, and may be cooled in a cooling step using, for example, water.

The cooled resin composition is then pulverized in a pulverization step to a desired particle diameter. In the pulverization step, for example, a coarse pulverization is performed using a grinder such as a crusher, hammer mill, or feather mill, followed by a fine pulverization using, for example, a pulverizer such as a Kryptron System (Kawasaki Heavy Industries, Ltd.), Super Rotor (Nisshin Engineering Inc.), or Turbo Mill (Turbo Kogyo Co., Ltd.) or using an air jet system.

The toner particle is then obtained as necessary by carrying out classification using a sieving apparatus or a classifier, e.g., an internal classification system such as the Elbow Jet (Nittetsu Mining Co., Ltd.) or a centrifugal classification system such as the Turboplex (Hosokawa Micron Corporation), TSP Separator (Hosokawa Micron Corporation), or Faculty (Hosokawa Micron Corporation).

The toner is then obtained optionally by the addition with mixing (external addition) of a selected external additive, e.g., an inorganic fine powder or resin particles, for example, to impart flowability and improve the charging stability. Mixing is carried out using a mixing apparatus that has a rotating element having a stirring member and that also has a main casing designed to have a gap with the stirring member.

Such a mixing apparatus can be exemplified by the Henschel mixer (Mitsui Mining Co., Ltd.); Supermixer (Kawata Mfg. Co., Ltd.); Ribocone (Okawara Corporation); Nauta mixer, Turbulizer, and Cyclomix (Hosokawa Micron Corporation); Spiral Pin Mixer (Pacific Machinery & Engineering Co., Ltd.); Loedige Mixer (Matsubo Corporation); and Nobilta (Hosokawa Micron Corporation). In particular, the Henschel mixer (Mitsui Mining Co., Ltd.) is preferably used in order to bring about uniform mixing and to break up silica aggregates.

The mixing apparatus conditions can be exemplified by the amount to be processed, the rotation rate for the stirring axle, the stirring time, the shape of the stirring impeller, the temperature in the vessel, and so forth, and are selected as appropriate considering, for example, the properties of the heat-treated toner particle and the type of additive, in order to achieve the desired toner properties, but are not particularly limited.

In addition, a sieving device may optionally also be used when, for example, coarse additive aggregates are released into and are then present in the resulting toner.

The methods used to measure the various properties of the starting materials and toner in the present invention are described in the following.

Method for Measuring the Peak Molecular Weight (Mp), Number-Average Molecular Weight (Mn), and Weight-Average Molecular Weight (Mw) of the Resins The peak molecular weight (Mp), number-average molecular weight (Mn), and weight-average molecular weight (Mw) are measured as follows using gel permeation chromatography (GPC).

First, the sample (resin) is dissolved in tetrahydrofuran (THF) for 24 hours at room temperature. The obtained solution is filtered using a "Sample Pretreatment Cartridge" (Tosoh Corporation) solvent-resistant membrane filter having a pore diameter of 0.2 μm to obtain a sample solution. The sample solution is adjusted to a concentration of THF-soluble component of approximately 0.8 mass %. Measurement is carried out under the following conditions using this sample solution.

instrument: HLC8120 GPC (detector: RI) (Tosoh Corporation)

column: 7-column train of Shodex KF-801, 802, 803, 804, 805, 806, and 807 (Showa Denko Kabushiki Kaisha)

eluent: tetrahydrofuran (THF)

flow rate: 1.0 mL/min oven temperature: 40.0° C.

amount of sample injection: 0.10 mL

A molecular weight calibration curve constructed using polystyrene resin standards (for example, product name "TSK Standard Polystyrene F-850, F-450, F-288, F-128, F-80, F-40, F-20, F-10, F-4, F-2, F-1, A-5000, A-2500, A-1000, A-500", Tosoh Corporation) is used to determine the molecular weight of the sample.

Method for Measuring the Softening Point of the Resins

The softening point of the resins is measured using a "Flowtester CFT-500D Flow Property Evaluation Instrument" (Shimadzu Corporation), a constant-load extrusion-type capillary rheometer, in accordance with the manual provided with the instrument. With this instrument, while a constant load is applied by a piston from the top of the measurement sample, the measurement sample filled in a cylinder is heated and melted and the melted measurement sample is extruded from a die at the bottom of the cylinder;

a flow curve showing the relationship between piston stroke and temperature is obtained from this.

The "melting temperature by the ½ method", as described in the manual provided with the "Flowtester CFT-500D Flow Property Evaluation Instrument", is used as the softening point in the present invention. The melting temperature by the ½ method is determined as follows. First, ½ of the difference between Smax, which is the piston stroke at the completion of outflow, and Smin, which is the piston stroke at the start of outflow, is determined (this value is designated as X, where X=(Smax−Smin)/2). The temperature of the flow curve when the piston stroke in the flow curve reaches the sum of X and Smin is the melting temperature by the ½ method.

The measurement sample used is prepared by subjecting approximately 1.0 g of the resin to compression molding for approximately 60 seconds at approximately 10 MPa in a 25° C. environment using a tablet compression molder (for example, NT-100H, NPa System Co., Ltd.) to provide a cylindrical shape with a diameter of approximately 8 mm.

The measurement conditions with the CFT-500D are as follows.

test mode: ramp-up method
start temperature: 40° C.
saturated temperature: 200° C.
measurement interval: 1.0° C.
ramp rate: 4.0° C./min
piston cross section area: 1.000 $cm^2$
test load (piston load): 10.0 kgf (0.9807 MPa)
preheating time: 300 seconds
diameter of die orifice: 1.0 mm
die length: 1.0 mm Method for Measuring the Acid Value of the Resins The acid value is the number of milligrams of potassium hydroxide required to neutralize the acid present in 1 g of a sample. The acid value of the binder resin is measured in accordance with HS K 0070-1992, and is specifically measured using the following procedure.

(1) Reagent Preparation

A phenolphthalein solution is obtained by dissolving 1.0 g of phenolphthalein in 90 mL of ethyl alcohol (95 volume %) and bringing to 100 mL by adding deionized water.

7 g of special-grade potassium hydroxide is dissolved in 5 mL of water and this is brought to 1 L by the addition of ethyl alcohol (95 volume %). This is introduced into an alkali-resistant container avoiding contact with, for example, carbon dioxide, and is allowed to stand for 3 days, after which time filtration is carried out to obtain a potassium hydroxide solution. The obtained potassium hydroxide solution is stored in an alkali-resistant container. The factor for this potassium hydroxide solution is determined from the amount of the potassium hydroxide solution required for neutralization when 25 mL of 0.1 mol/L hydrochloric acid is introduced into an Erlenmeyer flask, several drops of the phenolphthalein solution are added, and titration is performed using the potassium hydroxide solution. The 0.1 mol/L hydrochloric acid used is prepared in accordance with JIS K 8001-1998.

(2) Procedure (A) Main Test 2.0 g of the sample is exactly weighed into a 200-mL Erlenmeyer flask and 100 mL of a toluene/ethanol (2:1) mixed solution is added and dissolution is carried out over 5 hours. Several drops of the phenolphthalein solution are added as indicator and titration is performed using the potassium hydroxide solution. The titration endpoint is taken to be the persistence of the faint pink color of the indicator for approximately 30 seconds.

(B) Blank Test

The same titration as in the above procedure is run, but without using the sample (that is, with only the toluene/ethanol (2:1) mixed solution).

(3) The acid value is calculated by substituting the obtained results into the following formula.

$$A=[(C-B)\times f\times 5.61]/S$$

Here, A: acid value (mg KOH/g); B: amount (mL) of addition of the potassium hydroxide solution in the blank test; C: amount (mL) of addition of the potassium hydroxide solution in the main test; f: factor for the potassium hydroxide solution; and S: sample (g).

Method for Measuring the Hydroxyl Value of the Resins

The hydroxyl value is the number of milligrams of potassium hydroxide required to neutralize the acetic acid bonded to the hydroxyl group when 1 g of the sample is acetylated. The hydroxyl value of the resins is measured in accordance with JIS K 0070-1992, and is specifically measured using the following procedure.

(1) Reagent Preparation 25 g of special-grade acetic anhydride is introduced into a 100-mL volumetric flask; the total volume is brought to 100 mL by the addition of pyridine; and thorough shaking then provides the acetylation reagent. The obtained acetylation reagent is stored in a brown bottle isolated from contact with, e.g., humidity, carbon dioxide, and so forth.

A phenolphthalein solution is obtained by dissolving 1.0 g of phenolphthalein in 90 mL of ethyl alcohol (95 volume %) and bringing to 100 mL by adding deionized water.

35 g of special-grade potassium hydroxide is dissolved in 20 mL of water and this is brought to 1 L by the addition of ethyl alcohol (95 volume %). This is introduced into an alkali-resistant container avoiding contact with, for example, carbon dioxide, and is allowed to stand for 3 days, after which time filtration is carried out to obtain a potassium hydroxide solution. The obtained potassium hydroxide solution is stored in an alkali-resistant container. The factor for this potassium hydroxide solution is determined from the amount of the potassium hydroxide solution required for neutralization when 25 mL of 0.5 mol/L hydrochloric acid is introduced into an Erlenmeyer flask, several drops of the phenolphthalein solution are added, and titration is performed using the potassium hydroxide solution. The 0.5 mol/L hydrochloric acid used is prepared in accordance with JIS K 8001-1998.

(2) Procedure (A) Main Test

A 1.0 g sample of the pulverized resin is exactly weighed into a 200-mL roundbottom flask and exactly 5.0 mL of the above-described acetylation reagent is added using a whole pipette. When the sample is difficult to dissolve in the acetylation reagent, dissolution is carried out by the addition of a small amount of special-grade toluene.

A small funnel is mounted in the mouth of the flask and heating is then carried out by immersing about 1 cm of the bottom of the flask in a glycerol bath at approximately 97° C. In order at this point to prevent the temperature at the neck of the flask from rising due to the heat from the bath, thick paper in which a round hole has been made is preferably mounted at the base of the neck of the flask.

After 1 hour, the flask is taken off the glycerol bath and allowed to cool. After cooling, the acetic anhydride is hydrolyzed by adding 1 mL of water from the funnel and shaking. In order to accomplish complete hydrolysis, the flask is again heated for 10 minutes on the glycerol bath. After cooling, the funnel and flask walls are washed with 5 mL of ethyl alcohol.

Several drops of the above-described phenolphthalein solution are added as the indicator and titration is performed using the above-described potassium hydroxide solution. The endpoint for the titration is taken to be the point at which the pale pink color of the indicator persists for approximately 30 seconds.

(B) Blank Test

Titration is performed using the same procedure as described above, but without using the resin sample.

(3) The hydroxyl value is calculated by substituting the obtained results into the following formula.

$$A=[\{(B-C)\times 28.05\times f\}/S]+D$$

Here, A: hydroxyl value (mg KOH/g); B: amount (mL) of addition of the potassium hydroxide solution in the blank test; C: amount (mL) of addition of the potassium hydroxide solution in the main test; f: factor for the potassium hydroxide solution; S: sample (g); and D: acid value (mg KOH/g) of the resin.

Measurement of the Maximum Endothermic Peak of the Wax

The peak temperature of the maximum endothermic peak of the wax is measured based on ASTM D 3418-82 using a "Q1000" differential scanning calorimeter (TA Instruments). Temperature correction in the instrument detection section is performed using the melting points of indium and zinc, and the amount of heat is corrected using the heat of fusion of indium.

Specifically, approximately 10 mg of the wax is exactly weighed out and this is introduced into an aluminum pan, and the measurement is run at a ramp rate of 10° C./minute in the measurement temperature range between 30° C. and 200° C. using an empty aluminum pan as reference. The measurement is carried out by initially raising the temperature to 200° C., then cooling to 30° C., and then reheating. The peak temperature of the maximum endothermic peak of the wax is taken to be the temperature that gives the maximum endothermic peak in the DSC curve in the 30° C. to 200° C. temperature range in this second ramp-up process.

Measurement of the Content of Compound (1) in the Toner

Measurement of the content of the compound (1) in the toner can use, for example, an "RINT-TTRII" (Rigaku Corporation) analyzer for the x-ray diffraction instrument and the control software and analysis software provided with the instrument.

The measurement conditions are as follows:

x-ray: Cu/50 kV/300 mA
goniometer: rotor horizontal goniometer (TTR-2)
attachment: standard sample holder
divergence slit: open
divergence vertical slit: 10.00 mm
scattering slit: open
light-receiving slit: open
counter: scintillation counter
scanning mode: continuous
scanning speed: 4.0000°/minute
sampling width: 0.0200°
scanning axis: 2θ/θ
scanning range: 10.0000 to 40.0000°

The toner to be tested is set in the sample plate and the measurement is started. The measurement is carried out using CuKα characteristic x-rays in the diffraction angle (2θ±0.20 deg) range of 3 deg to 35 deg, and the integrated intensity of the spectrum at 2θ from 4.0 deg to 5.0 deg in the obtained spectrum is compared with a preliminarily constructed calibration curve built as a function of the amount of compound (1) to determine the content of the compound (1) in the toner.

Measurement of the Content of the Colorant in the Toner

Measurement of the content of the colorant in the toner can use, for example, an "RINT-TTRII" (Rigaku Corporation) analyzer for the x-ray diffraction instrument and the control software and analysis software provided with the instrument.

The measurement conditions are as follows:

x-ray: Cu/50 kV/300 mA
goniometer: rotor horizontal goniometer (TTR-2)
attachment: standard sample holder
divergence slit: open
divergence vertical slit: 10.00 mm
scattering slit: open
light-receiving slit: open
counter: scintillation counter
scanning mode: continuous
scanning speed: 4.0000°/minute
sampling width: 0.0200°
scanning axis: 2θ/θ
scanning range: 10.0000 to 40.0000°

The toner to be tested is set in the sample plate and the measurement is started. The measurement is carried out using CuKα characteristic x-rays in the diffraction angle (2θ±0.20 deg) range of 3.00 deg to 35.00 deg, and the content of the colorant in the toner is determined by subtracting, from the total integrated intensity of the obtained spectrum, the integrated intensity of the spectrum that does not originate from the colorant.

Measurement of the Content in the Toner of the Compound in Which Compound (2) and Compound (3) are in Solid Solution This can be detected from the peak intensity at a diffraction angle (2θ±0.20 deg) of 5.80 deg with the CuKα characteristic x-rays obtained in the measurements described in the preceding.

A peak is not seen in the indicated range when the compound (2) and compound (3) are not in solid solution, for example, when the compound (2) simple substance and the compound (3) simple substance are present or when a mixture of the compound (2) and the compound (3) is present.

Measurement of the Acid Value of the Polyester Resin from the Toner

The following method can be used to measure the acid value of the polyester resin from the toner. The polyester resin is separated from the toner using the following method and the acid value is then measured.

The toner is dissolved in tetrahydrofuran (THF) and the solvent is distillatively removed under reduced pressure from the resulting soluble component to obtain the tetrahydrofuran (THF)-soluble component of the toner.

The obtained tetrahydrofuran (THF)-soluble component of the toner is dissolved in chloroform to prepare a sample solution having a concentration of 25 mg/mL.

3.5 mL of the obtained sample solution is introduced into the instrument described in the following, and the molecular weight equal to and greater than 2,000 is fractionated as the resin component using the following conditions.

preparative GPC instrument: Preparative HPLC Model LC-980 from Japan Analytical Industry Co., Ltd.

preparative column: JAIGEL 3H, JAIGEL 5H (Japan Analytical Industry Co., Ltd.)

eluent: chloroform flow rate: 3.5 mL/minute

After fractionation of the resin-derived high molecular weight component, the solvent is distillatively removed under reduced pressure and drying is performed for 24 hours under reduced pressure in a 90° C. atmosphere. This process is repeated until approximately 2.0 g of the resin component is obtained. Using the obtained sample, the acid value is measured using the procedure that has already been described above.

EXAMPLES

The basic constitution and features of the present invention are described in the preceding, while the present invention is specifically described in the following based on examples. However, the present invention is in no way limited to or by these examples. Unless specifically indicated otherwise, parts and % in the examples are on a mass basis.

Production of Compound (2)

50 parts of 3-hydroxy-4-methoxybenzanilide was uniformly dispersed in 1,000 parts of water; the temperature was brought to 0° C. to 5° C. by the addition of ice; 60 parts of a 35% aqueous HCl solution was gradually added dropwise while stirring at high speed; and strong stirring was then continued for 20 minutes. 50 parts of a 30% aqueous sodium nitrite solution was subsequently added with stirring for 60 minutes, followed by the addition of 2 parts of sulfamic acid to extinguish the nitrous acid. 50 parts of sodium acetate and 75 parts of 90% acetic acid were added to give a diazonium salt solution.

Separately from this, a coupler solution was prepared by dissolving 50 parts of N-phenyl-2-naphthalenecarboxamide, at a temperature not above 80° C., with 1,000 parts of water and 25 parts of sodium hydroxide and adding 3 parts of sodium alkylbenzenesulfonate.

While holding the coupler solution at or below 10° C., the diazonium salt solution was introduced in a single addition under strong stirring. After this introduction, gentle stirring was continued until completion of the coupling reaction, followed by heating to 120° C. and filtration to obtain the compound (2).

Production of Compounds (1)-A to (1)-F

Coloring compounds (1)-A to (1)-F were produced using the methods described in the following.

Production Example 1: Production of Compound (1)-A 100 mg of p-toluenesulfonic acid was added to a suspension of 10 mmol of the pyridone compound (1) in 20 mL toluene; the temperature was raised to 70° C.; and a solution of 10 mmol of the aldehyde compound (1) in 20 mL toluene was added dropwise. Heating under reflux was then carried out for 6 hours at 160° C. while carrying out the azeotropic separation of water. After the completion of the reaction, cooling to room temperature was performed and dilution with isopropanol was carried out. After concentration under reduced pressure, the residue was purified by column chromatography (developing solvent: ethyl acetate/heptane) to obtain the compound (1)-A.

Production Example 2: Production of Compound (1)-B

A solution of 10 mmol of the aldehyde compound (1) and 10 mmol of the pyridone compound (3) in 50 mL of methanol was stirred for 3 days at room temperature. After completion of the reaction, the compound (1)-B was obtained by dilution with isopropanol and filtration.

Production Example 3: Production of Compound (1)-C

A solution of 10 mmol of the aldehyde compound (2) and 10 mmol of the pyridone compound (2) in 50 mL of ethanol was stirred for 3 days at room temperature. After completion of the reaction, 5.1 g (87% yield) of compound (1)-C was obtained by dilution with isopropanol and filtration.

Production Example 4: Production of Compound (1)-D

The compound (1)-D was obtained proceeding by the same method as in the example of the production of compound (1)-B, but using the aldehyde compound (5) and the pyridone compound (4).

Production Example 5: Production of Compound (1)-E

The corresponding compound (1)-E was obtained by carrying out the same method as in Production Example 2, but changing the aldehyde compound (2) in Production Example 2 to the aldehyde compound (3) and changing the pyridone compound (3) to the pyridone compound (2).

Production Example 6: Production of Compound (1)-F

The corresponding compound (1)-F was obtained by carrying out the same method as in Production Example 2, but changing the aldehyde compound (2) in Production Example 2 to the aldehyde compound (4) and changing the pyridone compound (3) to the pyridone compound (2).

Compound (3) Production Example 50 parts of 3-hydroxy-4-methoxybenzanilide was uniformly dispersed in 1,000 parts of water; the temperature was brought to 0° C. to 5° C. by the addition of ice; 60 parts of a 35% aqueous HCl solution was gradually added dropwise while stirring at high speed; and strong stirring was continued for 20 minutes. 50 parts of a 30% aqueous sodium nitrite solution was subsequently added with stirring for 60 minutes, followed by the addition of 2 parts of sulfamic acid to extinguish the nitrous acid. 50 parts of sodium acetate and 75 parts of 90% acetic acid were added to give a diazonium salt solution.

Separately from this, a coupler solution was prepared by dissolving 50 parts of 3-hydroxy-4-[2-methoxy-5-(phenylcarbamoyl)phenylazo]-2-naphthalenecarboxamide, at a temperature not greater than 80° C., with 1,000 parts of water and 25 parts of sodium hydroxide and adding 3 parts of sodium alkylbenzenesulfonate.

While holding the coupler solution at or below 10° C., the diazonium salt solution was introduced in a single addition under strong stirring. After this introduction, gentle stirring was continued until completion of the coupling reaction, followed by heating to 120° C. and filtration to obtain the compound (3).

Solid Dissolution of Compound (2) and Compound (3)

48 parts of 3-amino-4-methoxybenzanilide was uniformly dispersed in 1,000 parts of water, and, operating under a temperature condition of not more than 5° C., 60 parts of 35% hydrochloric acid was added and stirring was carried out for 20 minutes. 50 parts of a 30% aqueous sodium nitrite solution was subsequently added with stirring for 60 minutes, followed by the addition of 2 parts of sulfamic acid to decompose and extinguish the excess nitrous acid. 50 parts of sodium acetate and 75 parts of 90% acetic acid were added to give a diazonium salt solution.

Separately from this, and operating under a temperature condition of not more than 5° C., 50 parts of compound (2) and 25 parts of compound (3) were dissolved in 1,000 parts of water along with 25 parts of sodium hydroxide, and an aqueous coupler solution was prepared by the addition of suitable amounts of an aqueous calcium chloride solution and, as a particle diameter modifier for the pigment composition, the anionic surfactant alkylbenzenesulfonic acid.

The aqueous diazonium salt solution was introduced in a single addition to the aqueous coupler solution while stirring, and a coupling reaction was run at a condition of pH 5 while holding the temperature at not greater than 5° C.

10 parts of abietic acid dissolved in 200 parts of a 0.1 mol/L aqueous sodium hydroxide solution was further added; thorough stirring was performed and the laking reaction was completed; and a thermal maturation treatment was run using a temperature condition of at least 90° C. to obtain a coarse pigment composition.

The coarse pigment composition was filtered off and washing with alkali was performed by redispersing the obtained pigment composition cake in an aqueous sodium hydroxide solution. After the alkali wash, the coarse pigment composition was again recovered by filtration and this was thoroughly washed with water. This process was repeated several times, followed by drying at elevated temperature and fine pulverization to obtain a calcium abietate-treated compound in which compound (2) and compound (3) were in solid solution.

Binder Resin 1 Production Example 76.9 parts (0.167 mol) of polyoxypropylene(2.2)-2,2-bis (4-hydroxyphenyl)propane, 25 parts (0.145 mol) of terephthalic acid (TPA), 8.0 parts (0.054 mol) of adipic acid, and 0.5 parts of titanium tetrabutoxide were introduced into a glass 4-liter four-neck flask, which was fitted with a thermometer, stirring rod, condenser, and nitrogen introduction line and placed in a mantle heater. The interior of the flask was then substituted with nitrogen gas, followed by gradually increasing the temperature while stirring and reacting for 4 hours while stirring at a temperature of 200° C. (first reaction step). Then, 1.2 parts (0.006 mol) of trimellitic anhydride (TMA) was added and a reaction was run for 1 hour at 180° C. (second reaction step) to obtain the binder resin 1.

This binder resin 1 had an acid value of 5 mg KOH/g and a hydroxyl value of 65 mg KOH/g. The molecular weight by GPC was 8,000 for the weight-average molecular weight (Mw), 3,500 for the number-average molecular weight (Mn), and 5,700 for the peak molecular weight (Mp), and the softening point was 90° C.

Binder Resin 2 Production Example 71.3 parts (0.155 mol) of polyoxypropylene(2.2)-2,2-bis (4-hydroxyphenyl)propane, 24.1 parts (0.145 mol) of terephthalic acid, and 0.6 parts of titanium tetrabutoxide were introduced into a glass 4-liter four-neck flask, which was fitted with a thermometer, stirring rod, condenser, and nitrogen introduction line and placed in a mantle heater. The interior of the flask was then substituted with nitrogen gas, followed by gradually increasing the temperature while stirring and reacting for 2 hours while stirring at a temperature of 200° C. (first reaction step). Then, 5.8 parts (0.030 mol) of trimellitic anhydride was added and a reaction was run for 10 hours at 180° C. (second reaction step) to obtain the binder resin 2.

This binder resin 2 had an acid value of 15 mg KOH/g and a hydroxyl value of 7 mg KOH/g. The molecular weight by GPC was 200,000 for the weight-average molecular weight (Mw), 5,000 for the number-average molecular weight (Mn), and 10,000 for the peak molecular weight (Mp), and the softening point was 130° C.

Binder Resin 3 Production Example 76.9 parts (0.167 mol) of polyoxypropylene(2.2)-2,2-bis (4-hydroxyphenyl)propane, 20.0 parts (0.120 mol) of terephthalic acid, 4.3 parts (0.060 mol) of acrylic acid, and 0.5 parts of titanium tetrabutoxide were introduced into a glass 4-liter four-neck flask, which was fitted with a thermometer, stirring rod, condenser, and nitrogen introduction line and placed in a mantle heater. The interior of the flask was then substituted with nitrogen gas, followed by gradually increasing the temperature while stirring and reacting for 4 hours while stirring at a temperature of 200° C. (first reaction step). Then, 1.0 parts (0.005 mol) of trimellitic anhydride was added and a reaction was run for 1 hour at 180° C. (second reaction step) to obtain the binder resin 3.

This binder resin 3 had an acid value of 0 mg KOH/g and a hydroxyl value of 82 mg KOH/g. The molecular weight by GPC was 8,000 for the weight-average molecular weight (Mw), 3,500 for the number-average molecular weight (Mn), and 5,700 for the peak molecular weight (Mp), and the softening point was 92° C.

Binder Resins 4 to 6 Production Example

Binder resins 4 to 6 were obtained proceeding as for binder resin 3, but, in order to adjust the acid value of the resulting binder resin, changing the amounts of addition of terephthalic acid and trimellitic anhydride as respectively shown in Table 1. The acid value and hydroxyl value of binder resins 4 to 6 are given in Table 1.

TABLE 1

| | monomer composition of the polyester resins | | | | | |
|---|---|---|---|---|---|---|
| | TPA (parts) | adipic acid (parts) | TMA (parts) | acrylic acid (parts) | acid value mgKOH/g | hydroxyl value mgKOH/g |
| binder resin 1 | 25.00 | 8.00 | 1.20 | — | 5.0 | 65.0 |
| binder resin 2 | 24.10 | — | 5.80 | — | 10.0 | 12.0 |

TABLE 1-continued

| | monomer composition of the polyester resins | | | | | |
|---|---|---|---|---|---|---|
| | TPA (parts) | adipic acid (parts) | TMA (parts) | acrylic acid (parts) | acid value mgKOH/g | hydroxyl value mgKOH/g |
| binder resin 3 | 20.00 | — | 1.00 | 4.30 | 0.0 | 82.0 |
| binder resin 4 | 24.10 | — | 3.50 | 4.30 | 15.0 | 57.0 |
| binder resin 5 | 24.10 | — | 4.70 | 4.30 | 20.0 | 54.0 |
| binder resin 6 | 24.10 | — | 5.30 | 4.30 | 25.0 | 56.5 |

Resin Composition 1 Production Example

| | |
|---|---|
| low-density polyethylene (Mw = 1,400, Mn = 850, maximum endothermic peak by DSC = 100° C.) | 18 parts |
| styrene | 66 parts |
| n-butyl acrylate | 13.5 parts |
| acrylonitrile | 2.5 parts |

were introduced into an autoclave, the interior of the system was replaced with $N_2$, and the temperature was then raised and was held at 180° C. while stirring. 50 parts of a xylene solution of 2 mass % t-butyl hydroperoxide was continuously added dropwise into the system over 5 hours. After cooling, the solvent was separated and removed to yield the resin composition 1, which had a vinyl resin component reacted onto the low-density polyethylene. Measurement of the molecular weight of resin composition 1 gave a weight-average molecular weight (Mw) of 7,100 and a number-average molecular weight (Mn) of 3,000. 69% was obtained for the transmittance at a wavelength of 600 nm as measured at a temperature of 25° C. on a dispersion yielded by dispersion in 45 volume % aqueous methanol.

Resin Composition 2 Production Example

| | |
|---|---|
| low-density polyethylene (Mw = 1,300, Mn = 800, maximum endothermic peak by DSC = 95° C.) | 20.0 parts |
| o-methylstyrene | 65.0 parts |
| n-butyl acrylate | 11.0 parts |
| methacrylonitrile | 4.0 parts |

were introduced into an autoclave, the interior of the system was replaced with $N_2$, and the temperature was then raised and was held at 170° C. while stirring. 50 parts of a xylene solution of 2 mass % t-butyl hydroperoxide was continuously added dropwise into the system over 5 hours. After cooling, the solvent was separated and removed to yield the resin composition 2, which had a vinyl resin component reacted onto the low-density polyethylene. Measurement of the molecular weight of resin composition 2 gave a weight-average molecular weight (Mw) of 6,900 and a number-average molecular weight (Mn) of 2,900. 63% was obtained for the transmittance at a wavelength of 600 nm as measured at a temperature of 25° C. on a dispersion yielded by dispersion in 45 volume % aqueous methanol.

Styrene-Acrylic Resin Production Method

| | |
|---|---|
| styrene | 70 parts |
| n-butyl acrylate | 25 parts |
| monobutyl maleate | 5 parts |
| di-t-butyl peroxide | 1 parts |

While stirring 200 parts of xylene in a four-neck flask, the interior of the vessel was thoroughly substituted with nitrogen and the temperature was raised to 120° C.; this was followed by the dropwise addition of the components listed above over 3.0 hours. The polymerization was completed after an additional xylene reflux, and solvent was distillatively removed under reduced pressure to obtain a styrene-acrylic resin.

Toner 1 Production Example

| | |
|---|---|
| binder resin 1 | 70.0 parts |
| binder resin 2 | 30.0 parts |
| Fischer-Tropsch wax (peak temperature of maximum endothermic peak = 78° C.) | 5.0 parts |
| coloring compound (1)-A | 1.0 parts |
| compound in which compound (2) and compound (3) are solid dissolved | 3.0 parts |
| aluminum 3,5-di-t-butylsalicylate compound | 0.5 parts |
| resin composition 1 | 5.0 parts |

The starting materials listed in the preceding formulation were mixed at a rotation rate of 20 $s^{-1}$ for a rotation time of 5 minutes using a Henschel mixture (Model FM-75, Mitsui Mining Co., Ltd.). This was followed by kneading using a twin-screw kneader (Model PCM-30, Ikegai Corporation) set to a temperature of 125° C. The obtained kneaded material was cooled and coarsely pulverized to 1 mm and below using a hammer mill to obtain a coarsely pulverized material. The resulting coarsely pulverized material was finely pulverized using a mechanical pulverizer (T-250, Turbo Kogyo Co., Ltd.). Classification was then carried out using a rotational classifier (200TSP, Hosokawa Micron Corporation) to yield the toner particle. With regard to the operating conditions for the rotational classifier (200TSP, Hosokawa Micron Corporation), the classification was performed at a classification rotor rotation rate of 50.0 $s^{-1}$. The obtained toner particle had a weight-average particle diameter (D4) of 6.2 μm.

The following were added to 100 parts of the resulting treated toner particle with mixing with a Henschel mixer (Model FM-75, Mitsui Mining Co., Ltd.) at a rotation rate of 30 $s^{-1}$ for a rotation time of 10 minutes to yield a toner 1:0.8 parts of hydrophobic silica fine particles having a number-average primary particle diameter of 10 nm, which had been subjected to a surface treatment with 20 mass % hexamethyldisilazane; 0.2 parts of titanium oxide fine particles having a number-average primary particle diameter of 30 nm, which had been subjected to a surface treatment with 16 mass % isobutyltrimethoxysilane.

Toners 2 to 14 and 16 to 18 Production Example

Toners 2 to 14 and 16 to 18 were obtained proceeding as in the Toner 1 Production Example, but changing, in accordance with Table 2, the species of binder resin, wax, resin composition, and compound (1) and their respective number of parts of addition.

Toner 15 Production Example 470 parts of deionized water and 3.3 parts of $Na_3PO_4$ were introduced into a 2-liter four-neck flask equipped with a CLEARMIX (M Technique Co., Ltd.) high-speed stirrer, and the rotation rate of the high-speed stirrer was set to 10,000 rpm and the temperature was raised to 65° C. An aqueous $CaCl_2$ solution was added to prepare an aqueous dispersion medium containing $Ca_3(PO_4)_2$, a microfine, sparingly water-soluble dispersing agent. On the other hand, a mixture of

| | |
|---|---|
| styrene | 66.0 parts |
| n-butyl acrylate | 34.0 parts |
| divinylbenzene | 0.2 parts |
| paraffin wax (peak temperature of maximum endothermic peak = 100° C.) | 5.0 parts |
| coloring compound (1)-A | 33.0 parts |
| compound in which compound (2) and compound (3) are solid dissolved | 3.0 parts |
| aluminum 3,5-di-t-butylsalicylate compound | 0.5 parts |

used as the material to be dispersed, was itself dispersed for 3 hours using an attritor (Mitsui Mining & Smelting Co., Ltd.). This was followed by the addition of 3 parts of 2,2'-azobis(2,4-dimethylvaleronitrile) at 65° C. and stirring for 1 minute to provide a polymerizable monomer composition.

After the polymerizable monomer composition had been prepared, the polymerizable monomer composition was introduced into the aqueous dispersion medium with the rotation rate of the high-speed stirrer raised to 15,000 rpm, and, while operating in an $N_2$ environment at an interior temperature of 60° C., the polymerizable monomer composition was granulated by stirring for 3 minutes. The stirrer was then changed over to a stirrer equipped with a paddle stirring impeller and stirring was carried out at 200 rpm while holding at the same temperature: the first reaction step was completed when the polymerization conversion of the polymerizable vinyl monomer reached 90%.

The reaction temperature was then raised to 80° C., and the second reaction step was finished, and the polymerization step was thus completed, when the polymerization conversion reached approximately 100%. After the completion of the polymerization and cooling, dilute hydrochloric acid was added to dissolve the sparingly water-soluble dispersing agent. Water washing was carried out several times on a pressure filter followed by a drying process to obtain polymer particles. These polymer particles had a weight-average particle diameter of 7.2 μm.

The following were added to 100 parts of the resulting polymer particles with mixing with a Henschel mixer (Model FM-75, Mitsui Mining Co., Ltd.) at a rotation rate of 30 $s^{-1}$ for a rotation time of 10 minutes to yield a toner 15:0.8 parts of hydrophobic silica fine particles having a number-average primary particle diameter of 10 nm, which had been subjected to a surface treatment with 20 mass % hexamethyldisilazane; 0.2 parts of titanium oxide fine particles having a number-average primary particle diameter of 30 nm, which had been subjected to a surface treatment with 16 mass % isobutyltrimethoxysilane.

Cyan Toner Production

| | |
|---|---|
| binder resin 1 | 70.0 parts |
| binder resin 2 | 30.0 parts |
| Fischer-Tropsch wax (peak temperature of maximum endothermic peak = 78° C.) | 5.0 parts |
| C.I. Pigment Blue 15:3 | 7.0 parts |
| aluminum 3,5-di-t-butylsalicylate compound | 0.5 parts |

The starting materials listed in the preceding formulation were mixed at a rotation rate of 20 $s^{-1}$ for a rotation time of 5 minutes using a Henschel mixture (Model FM-75, Mitsui Mining Co., Ltd.). This was followed by kneading using a twin-screw kneader (Model PCM-30, Ikegai Corporation) set to a temperature of 125° C. The obtained kneaded material was cooled and coarsely pulverized to 1 mm and below using a hammer mill to obtain a coarsely pulverized material. The resulting coarsely pulverized material was finely pulverized using a mechanical pulverizer (T-250, Turbo Kogyo Co., Ltd.). Classification was then carried out using a rotational classifier (200TSP, Hosokawa Micron Corporation) to yield the toner particle. With regard to the operating conditions for the rotational classifier (200TSP, Hosokawa Micron Corporation), the classification was performed at a classification rotor rotation rate of 50.0 $s^{-1}$. The obtained toner particle had a weight-average particle diameter (D4) of 6.2 μm.

The following were added to 100 parts of the resulting treated toner particle with mixing with a Henschel mixer (Model FM-75, Mitsui Mining Co., Ltd.) at a rotation rate of 30 $s^{-1}$ for a rotation time of 10 minutes to yield a cyan toner: 0.8 parts of hydrophobic silica fine particles having a number-average primary particle diameter of 10 nm, which had been subjected to a surface treatment with 20 mass % hexamethyldisilazane; 0.2 parts of titanium oxide fine particles having a number-average primary particle diameter of 30 nm, which had been subjected to a surface treatment with 16 mass % isobutyltrimethoxysilane.

TABLE 2

| toner | binder resin I | | binder resin II | | | wax | | | resin composition | | compound (1) | | compound S | |
|---|---|---|---|---|---|---|---|---|---|---|---|---|---|---|
| No. | No. | parts | No. | parts | AV | | melting point (° C.) | parts | No. | parts | No. | parts | parts | A/B |
| 1 | 1 | 70.0 | 2 | 30.0 | 6.5 | Fischer-Tropsch | 78 | 5.0 | 1 | 5.0 | (1)-A | 1.0 | 3.0 | 0.333 |
| 2 | 1 | 70.0 | 2 | 30.0 | 6.5 | Fischer-Tropsch | 78 | 5.0 | 1 | 5.0 | (1)-B | 1.0 | 3.0 | 0.333 |
| 3 | 1 | 70.0 | 2 | 30.0 | 6.5 | Fischer-Tropsch | 78 | 5.0 | 1 | 5.0 | (1)-C | 1.0 | 3.0 | 0.333 |

TABLE 2-continued

| toner | binder resin I | | binder resin II | | | wax | | | resin composition | | compound (1) | | compound S | |
|---|---|---|---|---|---|---|---|---|---|---|---|---|---|---|
| No. | No. | parts | No. | parts | AV | | melting point (° C.) | parts | No. | parts | No. | parts | parts | A/B |
| 4 | 1 | 70.0 | 2 | 30.0 | 6.5 | Fischer-Tropsch | 78 | 5.0 | 1 | 5.0 | (1)-D | 1.0 | 3.0 | 0.333 |
| 5 | 1 | 70.0 | 2 | 30.0 | 6.5 | Fischer-Tropsch | 78 | 5.0 | 1 | 5.0 | (1)-E | 1.0 | 3.0 | 0.333 |
| 6 | 1 | 70.0 | 2 | 30.0 | 6.5 | Fischer-Tropsch | 90 | 5.0 | 2 | 5.0 | (1)-F | 1.0 | 3.0 | 0.333 |
| 7 | 3 | 70.0 | 2 | 30.0 | 0.0 | paraffin wax | 100 | 5.0 | 2 | 5.0 | (1)-B | 0.3 | 10.0 | 0.030 |
| 8 | 4 | 70.0 | 2 | 30.0 | 15.0 | paraffin wax | 100 | 5.0 | 2 | 5.0 | (1)-B | 0.3 | 25.0 | 0.012 |
| 9 | 4 | 70.0 | 2 | 30.0 | 15.0 | paraffin wax | 100 | 5.0 | 2 | 5.0 | (1)-B | 18.0 | 3.0 | 6.000 |
| 10 | 4 | 70.0 | 2 | 30.0 | 15.0 | ester wax | 80 | 5.0 | 2 | 5.0 | (1)-B | 27.0 | 3.0 | 9.000 |
| 11 | 4 | 70.0 | 2 | 30.0 | 15.0 | ester wax | 80 | 5.0 | 2 | 5.0 | (1)-B | 0.1 | 15.0 | 0.007 |
| 12 | 5 | 70.0 | 2 | 30.0 | 20.0 | ester wax | 80 | 5.0 | — | — | (1)-B | 27.0 | 3.0 | 9.000 |
| 13 | 5 | 70.0 | 2 | 30.0 | 20.0 | ester wax | 80 | 5.0 | — | — | (1)-B | 0.1 | 25.0 | 0.004 |
| 14 | 6 | 70.0 | 2 | 30.0 | 25.0 | ester wax | 80 | 5.0 | — | — | (1)-B | 0.1 | 25.0 | 0.004 |
| 15 | styrene-acrylic resin 100.0 parts | | | | — | ester wax | 80 | 5.0 | — | — | (1)-B | 33.0 | 3.0 | 11.000 |
| 16 | 1 | 70.0 | 2 | 30.0 | 6.5 | Fischer-Tropsch | 78 | 5.0 | 2 | 5.0 | (1)-B | 1.0 | — | — |
| 17 | 1 | 70.0 | 2 | 30.0 | 6.5 | Fischer-Tropsch | 78 | 5.0 | 2 | 5.0 | (1)-B | 1.0 | — | — |
| 18 | 1 | 70.0 | 2 | 30.0 | 6.5 | Fischer-Tropsch | 78 | 5.0 | 2 | 5.0 | — | — | 3.0 | — |

In the Table, "AV" indicates acid value of polyester resin in toner (mgKOH/g) and "Compound S" indicates compound in which compounds (2) and (3) are in solid solution.

Magnetic Carrier Production Example

Water was added to 100 parts of $Fe_2O_3$ and milling was carried out for 15 minutes using a ball mill to produce a magnetic core having an average particle diameter of 55 μm.

A mixture of 1 parts of a straight silicone resin (KR271, Shin-Etsu Chemical Co., Ltd.), 0.5 parts of γ-aminopropyltriethoxysilane, and 98.5 parts of toluene was then added to 100 parts of the magnetic core, and, while stirring and mixing in a reduced-pressure solution kneader, drying was carried out under reduced pressure for 5 hours at 70° C. and the solvent was removed. This was followed by a baking treatment for 2 hours at 140° C. and then sieving on a shaking sieve (Model 300MM-2, Tsutsui Scientific Instruments Co., Ltd., aperture size=75 μm) to obtain a magnetic carrier 1.

Examples 1 to 15 and Comparative Examples 1 to 3

A two-component developer 1 was obtained by mixing the toner 1 and the magnetic carrier 1 so as to provide a toner concentration of 9 mass %; mixing was performed using a V-mixer (Model V-10, Tokuju Kosakusho Co., Ltd.) at 0.5 $s^{-1}$ for a rotation time of 5 minutes.

Two-component developers 2 to 18 and two-component developer C were obtained by changing the toner/magnetic carrier combinations as shown in Table 3. The evaluations described below were performed on the two-component developers of Examples 1 to 15 and Comparative Examples 1 to 3. The results of the evaluations are given in Table 4.

TABLE 3

| | toner No. | carrier No. | two-component developer No. |
|---|---|---|---|
| magenta developer | | | |
| Example 1 | 1 | 1 | 1 |
| Example 2 | 2 | 1 | 2 |
| Example 3 | 3 | 1 | 3 |
| Example 4 | 4 | 1 | 4 |
| Example 5 | 5 | 1 | 5 |
| Example 6 | 6 | 1 | 6 |
| Example 7 | 7 | 1 | 7 |
| Example 8 | 8 | 1 | 8 |
| Example 9 | 9 | 1 | 9 |
| Example 10 | 10 | 1 | 10 |
| Example 11 | 11 | 1 | 11 |
| Example 12 | 12 | 1 | 12 |
| Example 13 | 13 | 1 | 13 |
| Example 14 | 14 | 1 | 14 |
| Example 15 | 15 | 1 | 15 |
| Comparative Example 1 | 16 | 1 | 16 |
| Comparative Example 2 | 17 | 1 | 17 |
| Comparative Example 3 | 18 | 1 | 18 |
| cyan developer | | | |
| cyan toner | | 1 | C |

Method for Evaluating the Tinting Strength of the Toners

The evaluation was performed using a modified version of an imageRUNNER ADVANCE C5255, a full-color copier from Canon, Inc., as the image-forming apparatus, with the two-component developer 1 introduced into the developing device at the magenta station.

A normal temperature and normal humidity environment (23° C., 50% RH) was used for the evaluation environment, and GFC-081 plain copy paper (A4, areal weight=81.4 g/$m^2$, sold by Canon Marketing Japan Inc.) was used for the paper used in the evaluation.

First, while operating in the indicated evaluation environment, the relationship between the image density and the toner laid-on level on the paper was investigated by changing the toner laid-on level on the paper.

Adjustment was then performed so the image density of the FFH image (beta area) was 1.40 and the toner laid-on level was determined when the image density was 1.40.

This FFH is a value that gives 256 gradations in a hexadecimal format, wherein 00H is the 1st gradation (white background area) and FFH is the 256th gradation (solid area).

The image density was measured using an X-Rite color reflection densitometer (500 Series, X-Rite, Incorporated).

The tinting strength of the toner was evaluated from the obtained toner laid-on level (mg/cm$^2$). The results of the evaluation are given in Table 4.

Evaluation of the Color Reproducibility of the Toner

The evaluation was performed using a modified version of an imageRUNNER ADVANCE C5255, a full-color copier from Canon, Inc., as the image-forming apparatus, with the two-component developer 1 introduced into the developing device at the magenta station and the two-component developer C introduced into the developing device at the cyan station. A normal temperature and normal humidity environment (23° C., 50% RH) was used for the evaluation environment, and GFC-081 plain copy paper (A4, areal weight=81.4 g/m$^2$, sold by Canon Marketing Japan Inc.) was used for the paper used in the evaluation.

The formation of an image in the secondary color of blue was carried out using the two-component developer 1 and the two-component developer C. Separate images were formed in 16 gradations from 00H (solid white) to the FFH image (solid region). With regard to formation of the secondary colored image, the laid-on level that provided a monochrome image density of 1.40 was used for the laid-on level of the FFH image (solid region) of the two-component developer 1. In addition, with the two-component developer C, adjustment was carried out so the laid-on level for the FFH image (solid region) was 0.40 mg/cm$^2$. A laid-on level of 0.40 mg/cm$^2$ is the laid-on level that provides a monochrome image density of 1.40 with the two-component developer C. Using a SpectroScan Transmission (Gretag-Macbeth) (measurement conditions: $D_{50}$, viewing angle=2°), the L*, a*, and b* of the image at each gradation was measured on the secondary-colored (blue) images obtained at the 16 gradations, and C* was determined for each gradation using the following formula.

$$C^*=\{(a^*)^2+(b^*)^2\}^{0.5}$$

The maximum C* ($C^*_{max}$) was determined from a comparison of C* at each individual gradation and was used as the index in the evaluation of the blue color reproducibility. A larger $C^*_{max}$ indicates a better blue color reproducibility. The results of the evaluations are given in Table 4.

Method for Evaluating Fogging in Non-Image Areas (White Background Areas)

The evaluation was performed using a modified version of an imageRUNNER ADVANCE C5255, a full-color copier from Canon, Inc., as the image-forming apparatus, with the two-component developer 1 introduced into the developing device at the magenta station.

A normal temperature and normal humidity environment (23° C., 50% RH) was used for the evaluation environment, and GFC-081 plain copy paper (A4, areal weight=81.4 g/m$^2$, sold by Canon Marketing Japan Inc.) was used for the paper used in the evaluation.

Operating in the indicated environment, fogging in the white background region was measured both before and after a durability test.

The average reflectance Dr (%) of the evaluation paper prior to image output was measured using a reflectometer ("Reflectometer Model TC-6DS", Tokyo Denshoku Co., Ltd.).

The reflectance Ds (%) of the OOH image region (white background region) was measured both initially (1st print) and after a durability test (50,000th print). The fogging (%) was calculated using the following formula from the obtained Dr and Ds values (initial and after durability test).

$$\text{fogging}(\%)=Dr(\%)-Ds(\%)$$

The results of the evaluations are given in Table 4.

TABLE 4

| | tinting strength toner laid-on level that gives an image density of 1.40 (mg/cm$^2$) | color reproducibility C*max | fogging in non-image area: initial (%) | fogging in non-image area: after durability test (%) |
|---|---|---|---|---|
| Example 1 | 0.28 | 72 | 0.1 | 0.2 |
| Example 2 | 0.29 | 69 | 0.1 | 0.2 |
| Example 3 | 0.31 | 70 | 0.2 | 0.2 |
| Example 4 | 0.32 | 69 | 0.1 | 0.2 |
| Example 5 | 0.33 | 68 | 0.1 | 0.2 |
| Example 6 | 0.32 | 68 | 0.2 | 0.2 |
| Example 7 | 0.33 | 65 | 0.2 | 0.2 |
| Example 8 | 0.32 | 66 | 0.2 | 0.2 |
| Example 9 | 0.33 | 65 | 0.2 | 0.3 |
| Example 10 | 0.34 | 66 | 0.3 | 0.4 |
| Example 11 | 0.34 | 65 | 0.5 | 0.5 |
| Example 12 | 0.34 | 66 | 0.3 | 0.4 |
| Example 13 | 0.37 | 61 | 0.3 | 0.4 |
| Example 14 | 0.38 | 60 | 0.6 | 0.8 |
| Example 15 | 0.37 | 60 | 0.3 | 0.4 |
| Comparative Example 1 | 0.49 | 57 | 1.0 | 1.5 |
| Comparative Example 2 | 0.49 | 59 | 1.1 | 1.4 |
| Comparative Example 3 | 0.59 | 53 | 0.8 | 1.3 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-234174, filed Dec. 6, 2017, which is hereby incorporated by reference herein in its entirety.

What is claimed is:

1. A toner comprising a toner particle, the toner particle comprising:

a binder resin;

a compound represented by formula (1)

(1)

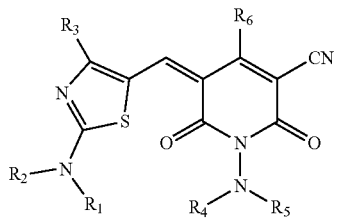

where $R_1$, $R_2$, $R_3$ and $R_6$ independently represent an alkyl group or aryl group, and $R_4$ and $R_5$ each independently represent an aryl group, acyl group or alkyl group, or $R_4$ is bonded to $R_5$ to form a cyclic organic functional group that contains $R_4$, $R_5$ and the nitrogen atom to which $R_4$ and $R_5$ are bonded; and a compound in which at least a compound represented by formula (2) and a compound represented by formula (3) are in solid solution (2)

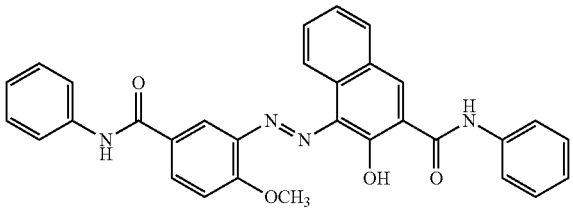

(3)

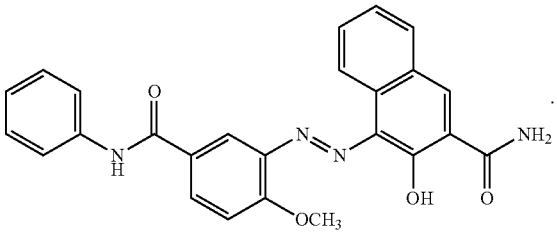

2. The toner according to claim 1, wherein the binder resin contains a polyester resin.

3. The toner according to claim 1, which satisfies $0.005 \leq A/B \leq 10.000$, wherein A is the content (mass parts) of compound (1) and B is the content (mass parts) of the compound in which compounds (2) and (3) are in solid solution.

4. The toner according to of claim 1, wherein $R_1$ and $R_2$ are independently an alkyl group having 1 to 15 carbon atoms, $R_3$ is an alkyl group having 1 to 6 carbon atoms or is represented by formula (4)

(4)

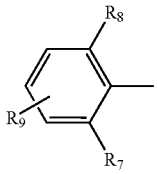

where $R_7$ and $R_8$ independently represent a hydrogen atom, an alkyl group having 1 to 6 carbon atoms or an alkoxy group having 1 to 6 carbon atoms and $R_9$ represents a hydrogen atom, alkyl group or alkoxy group, $R_6$ is an alkyl group having 1 to 10 carbon atoms, and $R_4$ and $R_5$ are independently an alkyl group having 1 to 6 carbon atoms, an alkylcarbonyl group having 2 to 10 carbon atoms or an arylcarbonyl group having 7 to 11 carbon atoms.

5. The toner according to claim 1, wherein the toner particle contains a graft polymer having a structure in which polyolefin is grafted to a vinyl resin component and/or a graft polymer having a structure in which a vinyl monomer is graft polymerized to a polyolefin.

6. The toner according to claim 1, wherein the toner particle contains a hydrocarbon wax.

* * * * *